US009147977B2

(12) United States Patent
Poulsen et al.

(10) Patent No.: US 9,147,977 B2
(45) Date of Patent: Sep. 29, 2015

(54) HIGH DENSITY HIGH SPEED DATA COMMUNICATIONS CONNECTOR

(71) Applicant: Leviton Manufacturing Co., Inc., Melville, NY (US)

(72) Inventors: Jeffrey Alan Poulsen, Edmonds, WA (US); Frank Chin-Hwan Kim, Woodinville, WA (US); Adam Bily, Seattle, WA (US); Bryan L. Sparrowhawk, Monroe, WA (US)

(73) Assignee: LEVITON MANUFACTURING CO., INC., Melville, NY (US)

( * ) Notice: Subject to any disclaimer, the term of this patent is extended or adjusted under 35 U.S.C. 154(b) by 231 days.

(21) Appl. No.: 13/924,405

(22) Filed: Jun. 21, 2013

(65) Prior Publication Data

US 2014/0154895 A1 Jun. 5, 2014

Related U.S. Application Data

(60) Provisional application No. 61/668,371, filed on Jul. 5, 2012.

(51) Int. Cl.
*H01R 12/00* (2006.01)
*H01R 13/658* (2011.01)
(Continued)

(52) U.S. Cl.
CPC ..... *H01R 13/658* (2013.01); *H01R 13/6463* (2013.01); *H01R 13/6586* (2013.01); *H01R 24/64* (2013.01); *H01R 13/518* (2013.01)

(58) Field of Classification Search
CPC .. H01R 13/646; H01R 13/518; H01R 13/658; H01R 13/6658
USPC ..... 439/76.1
See application file for complete search history.

(56) References Cited

U.S. PATENT DOCUMENTS 4,767,338 A 8/1988 Dennis et al.
6,866,548 B2 3/2005 Hashim
(Continued)

FOREIGN PATENT DOCUMENTS

KR 10-2007-0004816 1/2007

OTHER PUBLICATIONS

International Electrotechnical Commission, IEC, specification 61076-3-110 Ed. 1.0, 2007.
(Continued)

*Primary Examiner* — Jean F Duverne
(74) *Attorney, Agent, or Firm* — Davis Wright Tremaine LLP; George C. Rondeau, Jr.; Heather M. Colburn

(57) ABSTRACT

An outlet that includes first and second substrates, and a plurality of electrical contacts. The first substrate includes an electrical circuit adjacent to and spaced apart from a first ground plane. Each of the electrical contacts is connected to the circuit. The second substrate includes a second ground plane electrically connected to the first ground plane. The circuit is spaced apart from the second ground plane. The electrical contacts are positioned adjacent to the first and second substrates. Together the first and second ground planes may form a localized, electrically floating, isolated ground plane. The outlet may be connected to a cable and/or configured to be mounted to a panel for use with a rack. The outlet may be implemented as a Category 7A and/or Next Generation type outlet having an overall height that allows two rows of twenty-four like outlets to be mounted within one rack unit ("1RU").

53 Claims, 20 Drawing Sheets

(51) Int. Cl.

| | |
|---|---|
| ***H01R 13/6463*** | (2011.01) |
| ***H01R 13/6586*** | (2011.01) |
| ***H01R 24/64*** | (2011.01) |
| *H01R 13/518* | (2006.01) |

(56) References Cited

U.S. PATENT DOCUMENTS

| | | | | |
|---|---|---|---|---|
| 7,025,635 | B2 | 4/2006 | Chang | |
| 7,029,290 | B2 | 4/2006 | Wu | |
| 7,131,862 | B2 | 11/2006 | Vermeersch | |
| 7,448,909 | B2 | 11/2008 | Regnier et al. | |
| 7,517,254 | B2 * | 4/2009 | Zhang et al. | 439/668 |
| 7,618,264 | B2 | 11/2009 | Wu | |
| 7,651,341 | B2 | 1/2010 | Wu | |
| 7,651,342 | B1 | 1/2010 | Wu | |
| 7,654,831 | B1 | 2/2010 | Wu | |
| 7,658,622 | B2 | 2/2010 | Bartholomew | |
| 7,658,651 | B2 | 2/2010 | Pepe et al. | |
| 7,658,652 | B2 | 2/2010 | Sawatari et al. | |
| 7,674,136 | B2 | 3/2010 | Steinke et al. | |
| 7,722,390 | B2 | 5/2010 | Debenedictis et al. | |
| 7,736,176 | B2 * | 6/2010 | Zhang et al. | 439/541.5 |
| 7,794,278 | B2 | 9/2010 | Cohen et al. | |
| 7,845,984 | B2 | 12/2010 | Schaffer et al. | |
| 7,854,632 | B2 | 12/2010 | Reeves et al. | |
| 7,874,879 | B2 | 1/2011 | Caveney et al. | |
| 7,901,238 | B1 | 3/2011 | Muir et al. | |
| 8,011,950 | B2 * | 9/2011 | McGrath et al. | 439/497 |
| 8,062,073 | B1 | 11/2011 | Szczesny et al. | |
| 8,075,348 | B2 | 12/2011 | Mei et al. | |
| 8,096,839 | B2 * | 1/2012 | Abughazaleh et al. | 439/676 |
| 2001/0055916 | A1 | 12/2001 | Arnett | |
| 2003/0119343 | A1 | 6/2003 | Lin et al. | |
| 2004/0077222 | A1 | 4/2004 | AbuGhazaleh et al. | |
| 2005/0026509 | A1 | 2/2005 | Chang | |
| 2005/0202722 | A1 * | 9/2005 | Regnier et al. | 439/608 |
| 2006/0030172 | A1 | 2/2006 | Wu | |
| 2006/0091545 | A1 | 5/2006 | Casher et al. | |
| 2006/0094267 | A1 | 5/2006 | Li | |
| 2006/0121789 | A1 | 6/2006 | Hashim | |
| 2006/0134946 | A1 | 6/2006 | Vermeersch | |
| 2006/0266549 | A1 | 11/2006 | Lin et al. | |
| 2007/0105410 | A1 | 5/2007 | Wu | |
| 2007/0178772 | A1 | 8/2007 | Hashim et al. | |
| 2007/0184724 | A1 | 8/2007 | Adriaenssens et al. | |
| 2007/0187141 | A1 * | 8/2007 | Bartholomew | 174/261 |
| 2007/0259573 | A1 | 11/2007 | Machado et al. | |
| 2007/0293094 | A1 | 12/2007 | Aekins | |
| 2008/0214058 | A1 | 9/2008 | Machado et al. | |
| 2008/0305680 | A1 | 12/2008 | Little et al. | |
| 2008/0305692 | A1 | 12/2008 | Little et al. | |
| 2009/0104821 | A1 | 4/2009 | Marti et al. | |
| 2009/0191758 | A1 | 7/2009 | Aekins | |
| 2009/0197438 | A1 * | 8/2009 | Liu et al. | 439/76.1 |
| 2010/0093227 | A1 | 4/2010 | Kirk | |
| 2010/0210142 | A1 | 8/2010 | McGrath et al. | |
| 2011/0281474 | A1 | 11/2011 | Weinmann et al. | |
| 2012/0064779 | A1 | 3/2012 | Wu | |

OTHER PUBLICATIONS

Bel Stewart ARJ45 Plug data sheet, 2010.

* cited by examiner

HIGH DENSITY HIGH SPEED DATA COMMUNICATIONS CONNECTOR

CROSS REFERENCE TO RELATED APPLICATION(S)

This application claims the benefit of U.S. Provisional Application No. 61/668,371, filed Jul. 5, 2012, which is incorporated herein by reference in its entirety.

BACKGROUND OF THE INVENTION

1. Field of the Invention

The present invention is directed generally to connectors used for high-speed data communications referred to as outlets or jacks and more particularly to such connectors configured in accordance with the Augmented Registered Jack 45 standard ("ARJ45").

2. Description of the Related Art

Various Classes of structured cabling performance are defined by the International Standards Organization ("ISO"). ISO/IEC 11801 defines Classes D, E and $E_A$ which can be implemented using Category 5e, 6, and 6A components (cables, outlets, and patch cords), respectively.

Class D cabling is specified to 100 MHz (megahertz), Class E to 250 MHz and Class $E_A$ to 500 MHz. Using sophisticated methods of digital signal processing, electronic manufacturers can produce transceiver devices that are capable of achieving up to 10 Giga bits per seconds throughput data rates on these types of cables.

Registered Jack 45 ("RJ45") is a designation used to describe a modular connector (8P8C) and wiring configuration often used in structured cabling systems. The physical connector is defined by international standard IEC 60603-7. The RJ45 designation refers to both outlets (jacks) and the corresponding mating connector, the plug. Category 5, 6, and $6_A$ performance can be achieved using various implementations of the RJ45 outlet and associated mating patch cords and cables. A patch cord is a length of cable typically terminated on both ends with a plug.

ISO/IEC 11801 also defines Class F and $F_A$ cabling standards which can be used for Ethernet and other technologies. Class F cabling is implemented using Category 7 cables, outlets and patch cords while Class $F_A$ cabling is implemented using Category 7A cables, outlets and patch cords. To reduce crosstalk and system noise compared to Category 6 cables, Category F and $F_A$ cables include additional shielding added for individual wire pairs and the cable as a whole. Class F cabling is rated for transmission frequencies of up to 600 MHz while Class $F_A$ cabling is rated for transmission frequencies of up to 1000 MHz. One type of connector that has been shown to be suitable for both Category 7 and Category 7A is the Augmented Registered Jack 45 (ARJ45) type connector which is defined by international standard IEC 61076-3-110. As with the RJ45 designation, AJR45 can refer to both the outlet (jack) and its mating connector, the plug.

Standards organizations ISO and TIA (Telecommunication Industry Association) are currently working on specifications for a "Next Generation" of cabling that will be capable of working to even higher frequencies (approximately 1.5-2 GHz). In conjunction with the proper electronic transceivers, "Next Generation" cabling should be capable of achieving rates of data transmission of approximately 40 Giga Bits per second. To date the ARJ45 interface has been shown to be capable of easily meeting all of the proposed transmission performance requirements needed for this application.

FIG. 1 illustrates a lateral cross-section of an exemplary Category 7A cable 10. The cable 10 includes a plurality of elongated wires 14 surrounded by an elongated shield 15, which is itself surrounded by an outer cable jacket 16. The shield 15 is electrically conductive and may be constructed from braided wire and/or metal foil.

The cable 10 includes eight wires "W-1" to "W-8" organized into twisted-wire pairs "P1" to "P4" each used to transmit a differential signal. For ease of illustration, the twisted-wire pair "P1" will be described as including the wires "W-4" and "W-5," the twisted-wire pair "P2" will be described as including the wires "W-1" and "W-2," the twisted-wire pair "P3" will be described as including the wires "W-3" and "W-6," and the twisted-wire pair "P4" will be described as including the wires "W-7" and "W-8." The twisted-wire pair "P1" is surrounded by a shield "S1." The twisted-wire pair "P2" is surrounded by a shield "S2." The twisted-wire pair "P3" is surrounded by a shield "S3." The twisted-wire pair "P4" is surrounded by a shield "S4." Each of the shields "S1" to "S4" is electrically conductive and may be constructed from metal foil.

The cable 10 also includes a drain wire 18 positioned inside the elongated shield 15 between the twisted-wire pairs "P1" to "P4." The drain wire 18 is electrically conductive and may be in contact with the shields "S1" to "S4."

A Category 7A cable may be terminated at one end or both ends by a Category 7A type plug, or a Category 7A outlet.

A plurality of outlets may be mounted in a patch panel that is in turn mounted within a rack. The patch panel typically allows for approximately 18 inches of usable horizontal distance in which to fit outlets or other equipment. Panels come in different heights. A standard panel occupies approximately 1.75 inches of vertical height in the rack and is therefore referred to as a one rack unit panel or "1 RU panel." For Category 5e, 6, and 6A outlets, overall dimensions and mounting features are fairly standardized among manufacturers and typically one or two rows of 24 outlets can be fit into a 1 RU panel. Often the same panel can be used for different manufacturers' outlets. However for the limited number of Category 7 and 7A outlets available today, overall dimensions are far less standardized and may not all be fit as such.

A need exists for a new outlet design capable of meeting the transmission performance requirements for Category 7A as well as those required for "Next Generation" cabling systems. In addition to transmission performance, the outlet should have overall dimensions that allow for 24 or 48 to be installed into a 1 RU space. Ideally, the overall dimensions and mounting features of the outlet should be similar to Category 5e, 6, and 6A outlets and usable within the same panel. The present application provides these and other advantages as will be apparent from the following detailed description and accompanying figures.

BRIEF DESCRIPTION OF THE SEVERAL VIEWS OF THE DRAWING(S)

DETAILED DESCRIPTION OF THE INVENTION

Figure 2:
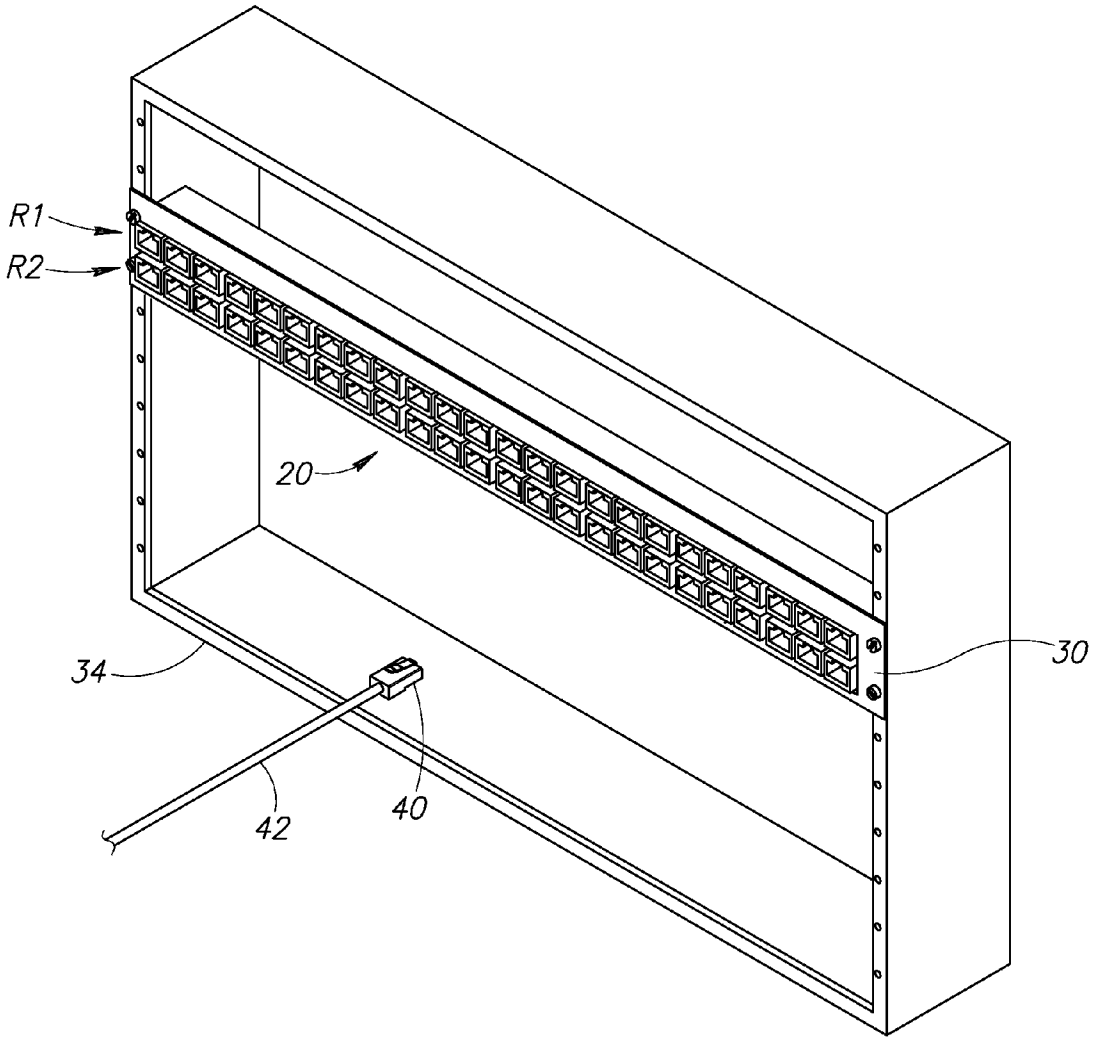
FIG. 2 is a perspective view of substantially identical outlets mounted inside a high-density patch panel.

FIG. 2 is a perspective view of 48 substantially identical outlets 20 mounted inside a high-density patch panel 30. Within the patch panel 30, the outlets 20 are arranged in two rows "R1" and "R2." In the embodiment illustrated, the patch panel 30 is configured to be mounted to a standard 19-inch wide rack 34 and fit within one rack unit ("1 RU"). Each of the outlets 20 may be constructed in such a manner as to meeting the electrical performance requirements of the Category 7A standard and the proposed requirements for "Next Generation" cabling. In such embodiments, the outlets 20 may each be characterized as being a Category 7A/Next Generation type outlet (based on the ARJ45 standard) having an overall height that allows two rows of 24 outlets to be mounted within 1 RU.

In FIG. 2, a cable 42 is terminated at one end by an ARJ45 type plug 40 that may be inserted into each of the outlets 20. The cable 42 may be substantially identical to the cable 10 illustrated in FIG. 1. The plug 40 may be constructed to be compatible with the Category 7A and the proposed "Next Generation" standards. As is apparent to those of ordinary skill in the art, up to 48 plugs substantially identical to the plug 40 may be inserted in the 48 outlets 20.

Figure 3A:
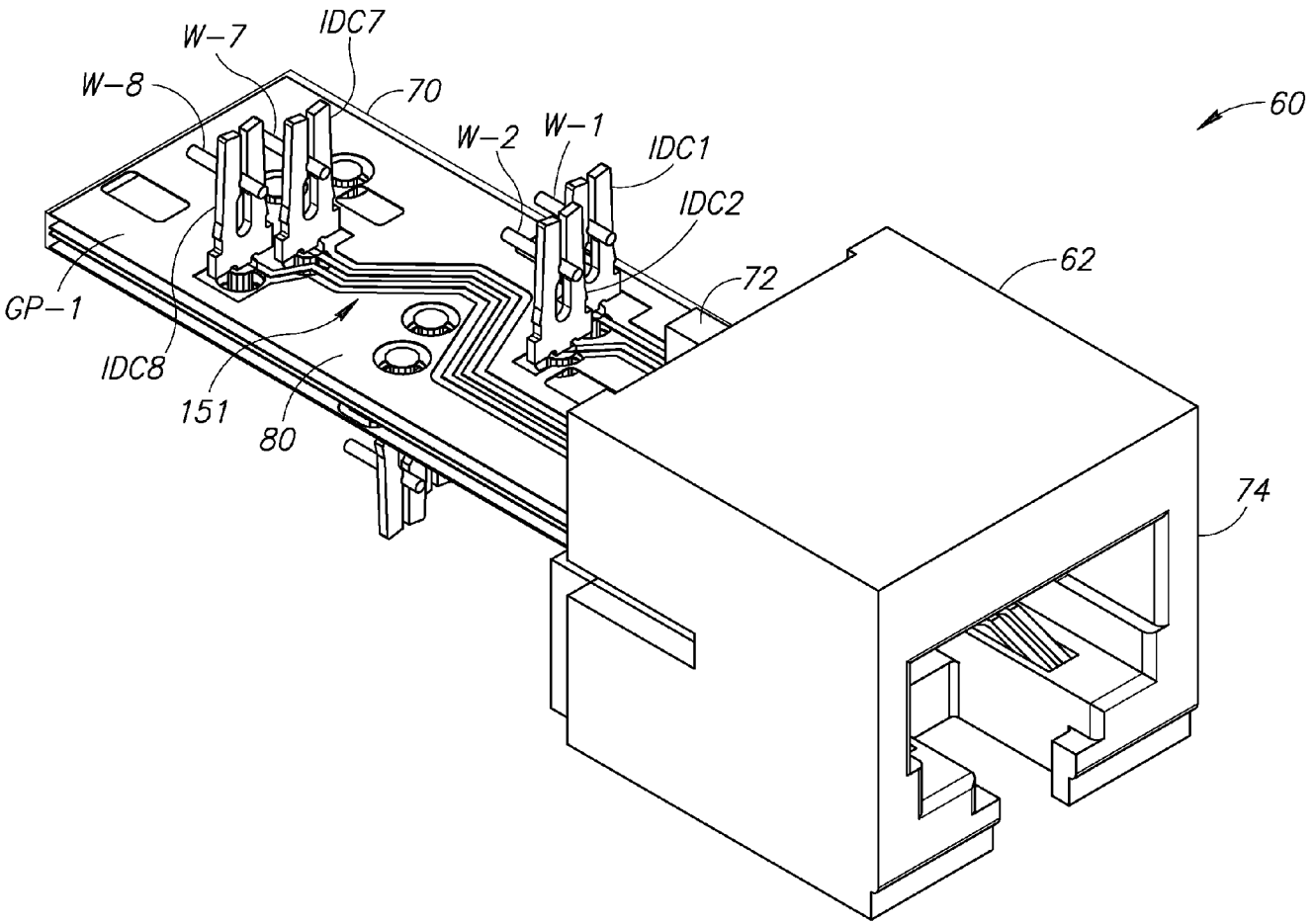
FIG. 3A is a first perspective view of an exemplary one of the outlets of FIG. 2 showing a plug insertion end.
Figure 3B:
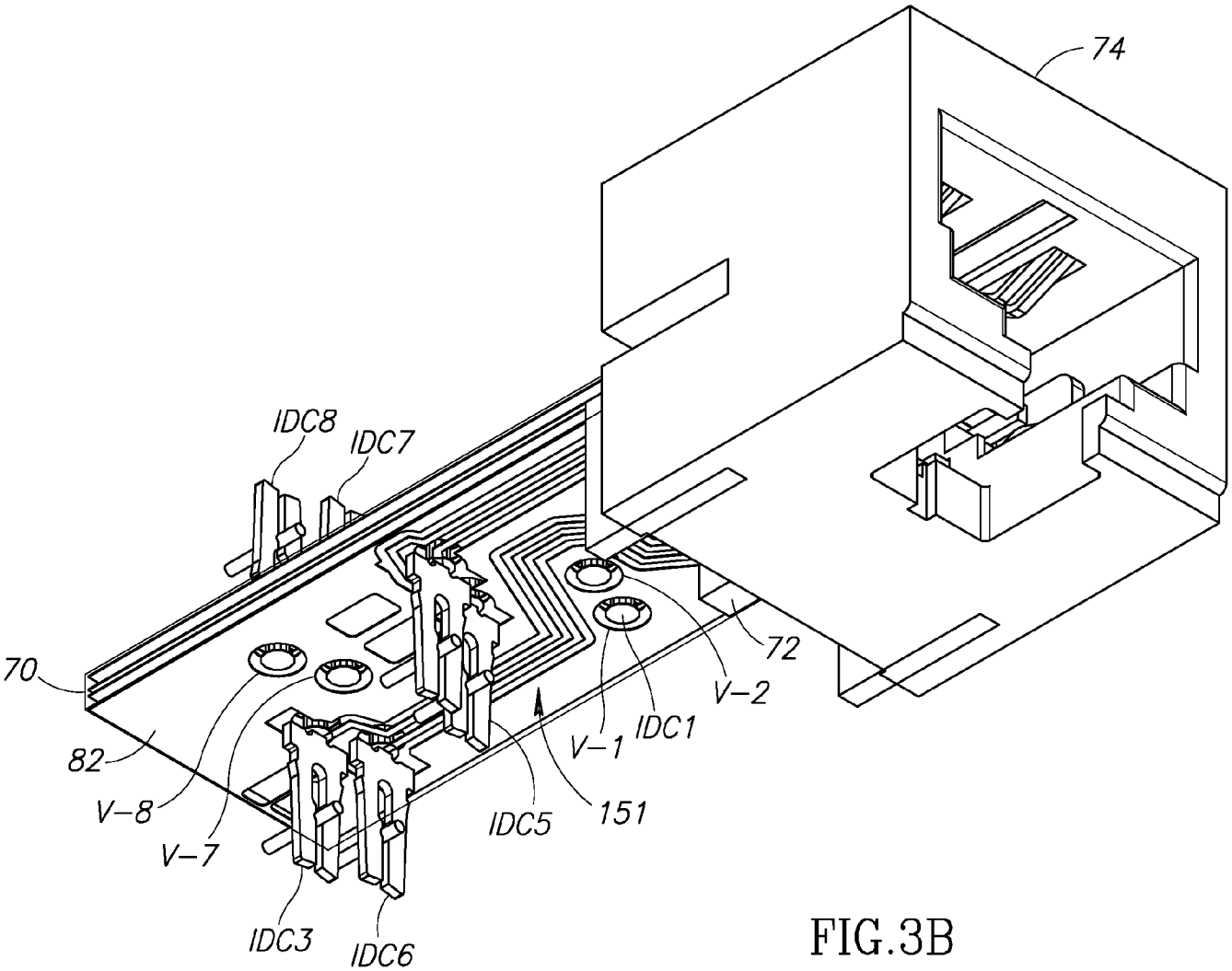
FIG. 3B is a second perspective view of the outlet of FIG. 3A showing the plug insertion end.
Figure 3C:
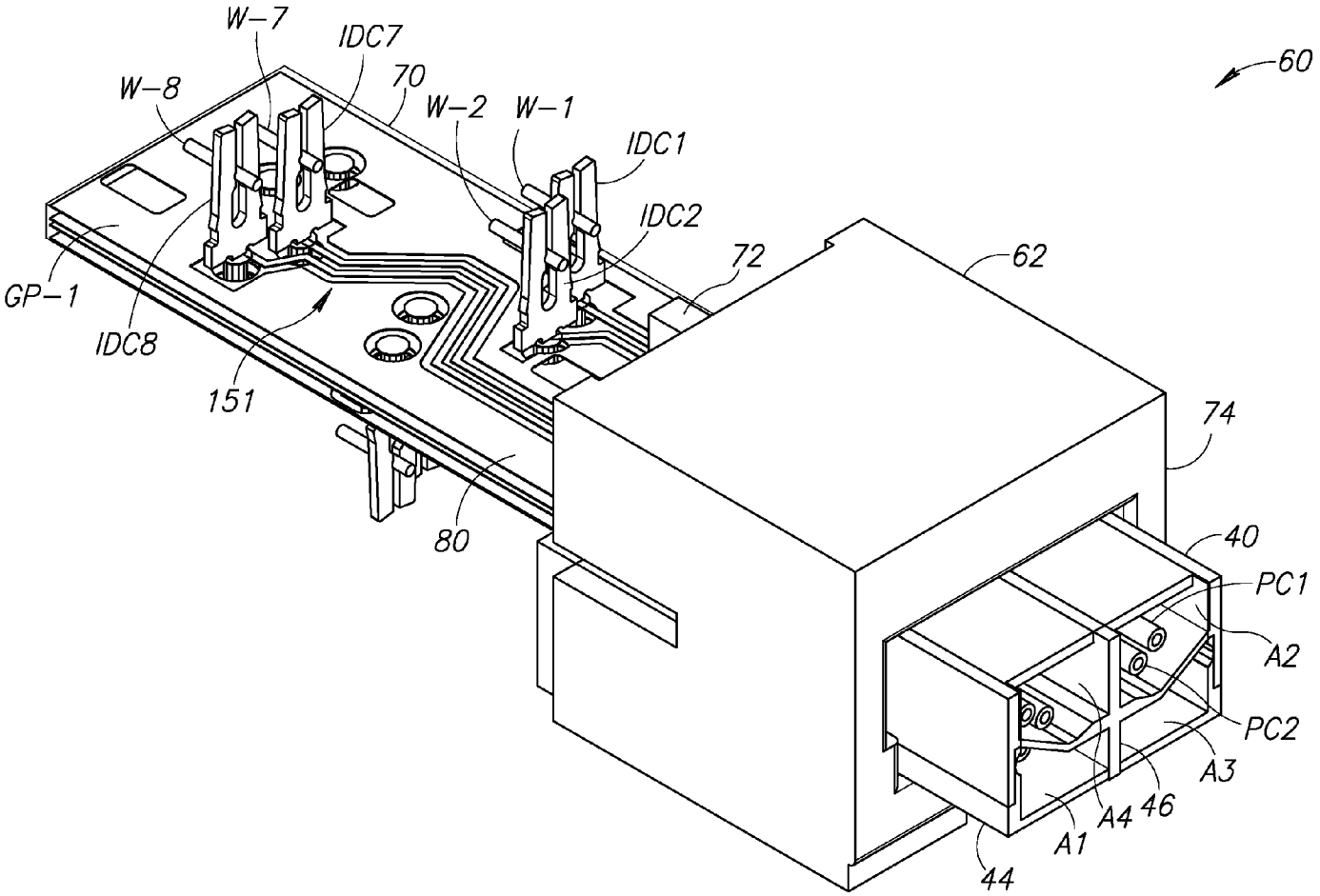
FIG. 3C is a third perspective view of the outlet of FIG. 3A with a plug inserted in the plug insertion end of the outlet.

FIGS. 3A and 3B are perspective views of an exemplary one of the outlets 20 (identified by reference numeral 60). FIGS. 3C-3F are perspective views of the outlets 60 with the plug 40 inserted therein. For ease of illustration, the cable 42 attached to the plug 40 in FIG. 2 has been omitted in FIGS. 3C-3F. Referring to FIG. 3C, the plug 40 includes a non-conductive plug housing 44, an electrically conductive plug shield 46, and eight conventional plug contacts "PC1" to "PC8" (see FIG. 4B). Inside the plug 40, the plug shield 46 has a generally t-shaped portion that divides the interior of the plug into regions "A1" to "A4."

The wires "W-4" and "W-5" (see FIG. 1) of the first twisted-wire pair "P1" of the cable 42 (see FIG. 2) are connected to the plug contacts "PC4" and "PC5" respectively. The wires "W-1" and "W-2" (see FIG. 1) of the second twisted-wire pair "P2" of the cable 42 (see FIG. 2) are connected to the plug contacts "PC1" and "PC2" respectively. The wires "W-3" and "W-6" (see FIG. 1) of the third twisted-wire pair "P3" of the cable 42 (see FIG. 2) are connected to the plug contacts "PC3" and "PC6" respectively. The wires "W-7" and "W-8" (see FIG. 1) of the fourth twisted-wire pair "P4" of the cable 42 (see FIG. 2) are connected to the plug contacts "PC7" and "PC8" respectively. The plug contacts "PC4" and "PC5" (see FIG. 4B) are positioned inside the first region "A1" and separated by the plug shield 46 from the other plug contacts "PC1" to "PC3" and "PC6" to "PC8." The plug contacts "PC1" and "PC2" are positioned inside the second region "A2" and separated by the plug shield 46 from the other plug contacts "PC3" to "PC8." The plug contacts "PC3" and "PC6" (see FIG. 4B) are positioned inside the third region "A3" and separated by the plug shield 46 from the other plug contacts "PC1," "PC2," "PC4," "PC5," "PC7," and "PC8." The plug contacts "PC7" and "PC8" (see FIG. 4B) are positioned inside the fourth region "A4" and separated by the plug shield 46 from the other plug contacts "PC1" to "PC6."

Figure 3D:
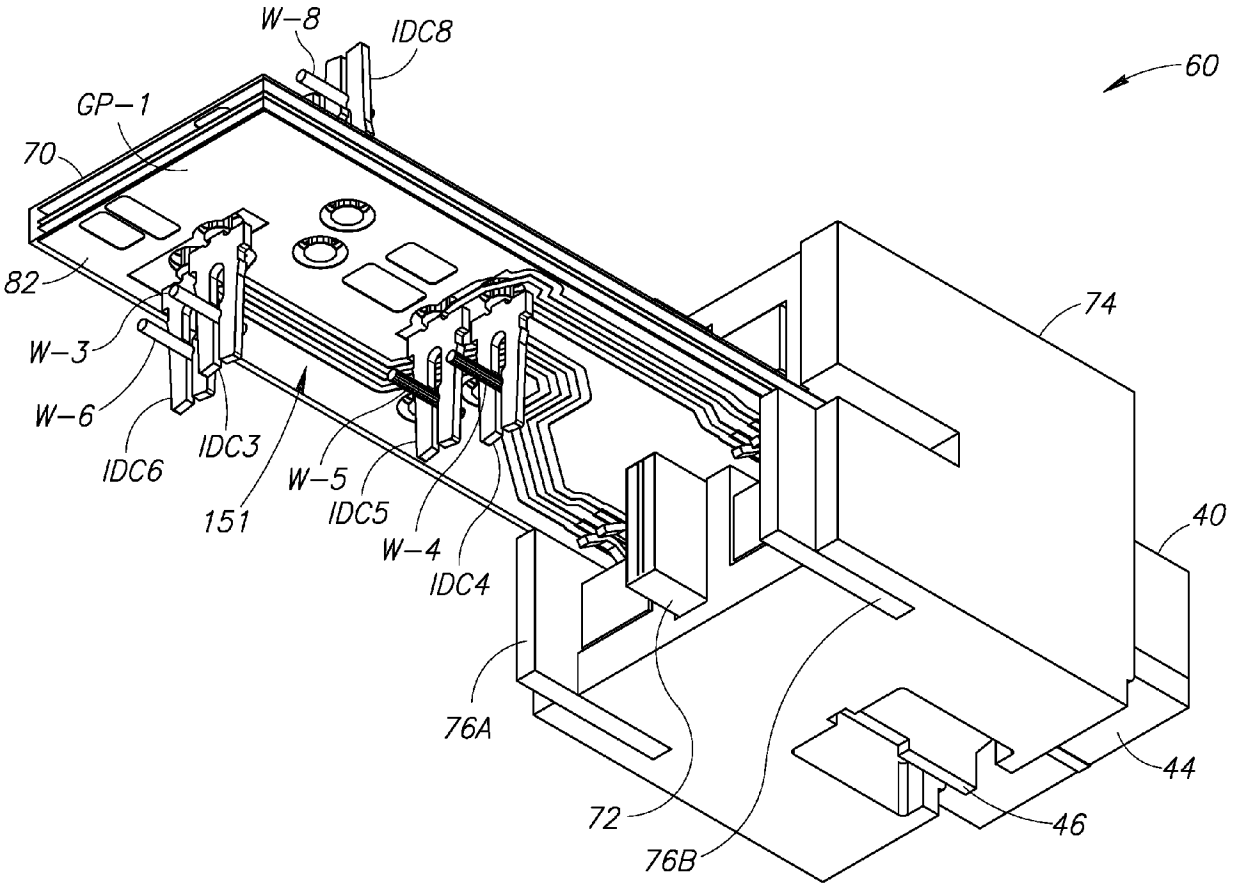
FIG. 3D is a fourth perspective view of the outlet of FIG. 3A with the plug inserted in the plug insertion end of the outlet.

The outlet 60 includes a plug interface assembly 62 (see FIG. 3C) and a first substrate 70 and a second substrate 72 (see FIG. 3D). For ease of illustration, the first substrate 70 will be referred to as a horizontal substrate and the second substrate 72 will be referred to as a vertical substrate. However, those of ordinary skill in the art appreciate that the assignment of the terms "horizontal" and "vertical" is arbitrary and not intended to be limiting. In the figures, the horizontal and vertical substrates 70 and 72 are each illustrated as printed circuit boards. The horizontal substrate 70 may be characterized as being a cable interface board. As will be described in detail below, both the horizontal and vertical substrates 70 and 72 provide shielding that reduces crosstalk within the outlet 60.

Plug Interface Assembly 62

Turning to FIGS. 3A-3F, the plug interface assembly 62 includes a housing 74. The housing 74 may include electrically conductive shielding (not shown). By way of a non-limiting example, the housing 74 may be constructed from die-cast metal, a polymer with a conductive coating (e.g., a coating electro-deposited on the polymer), and the like.

Figure 3E:
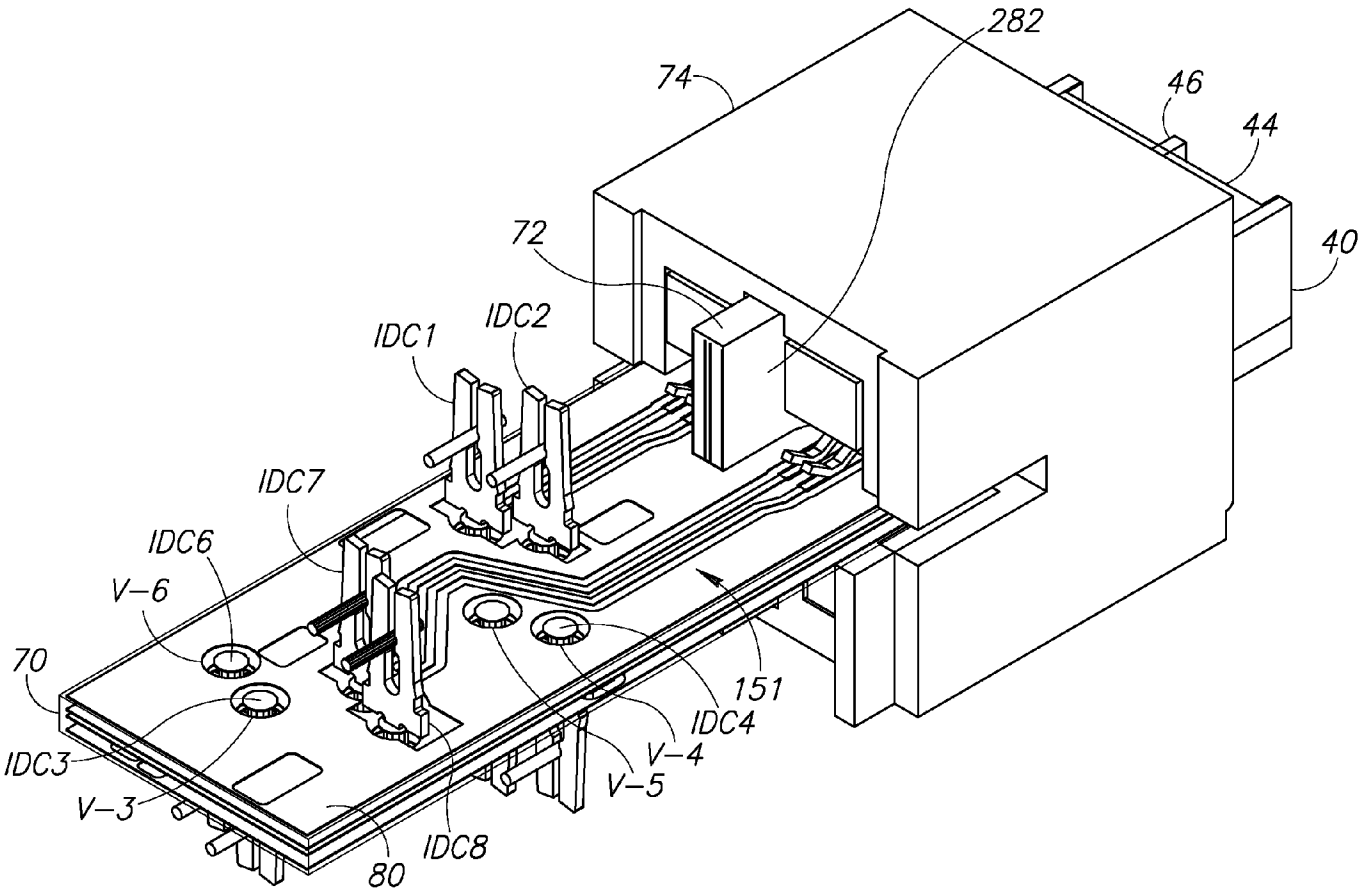
FIG. 3E is a fifth perspective view of the outlet of FIG. 3A with the plug inserted in the plug insertion end of the outlet.
Figure 3F:
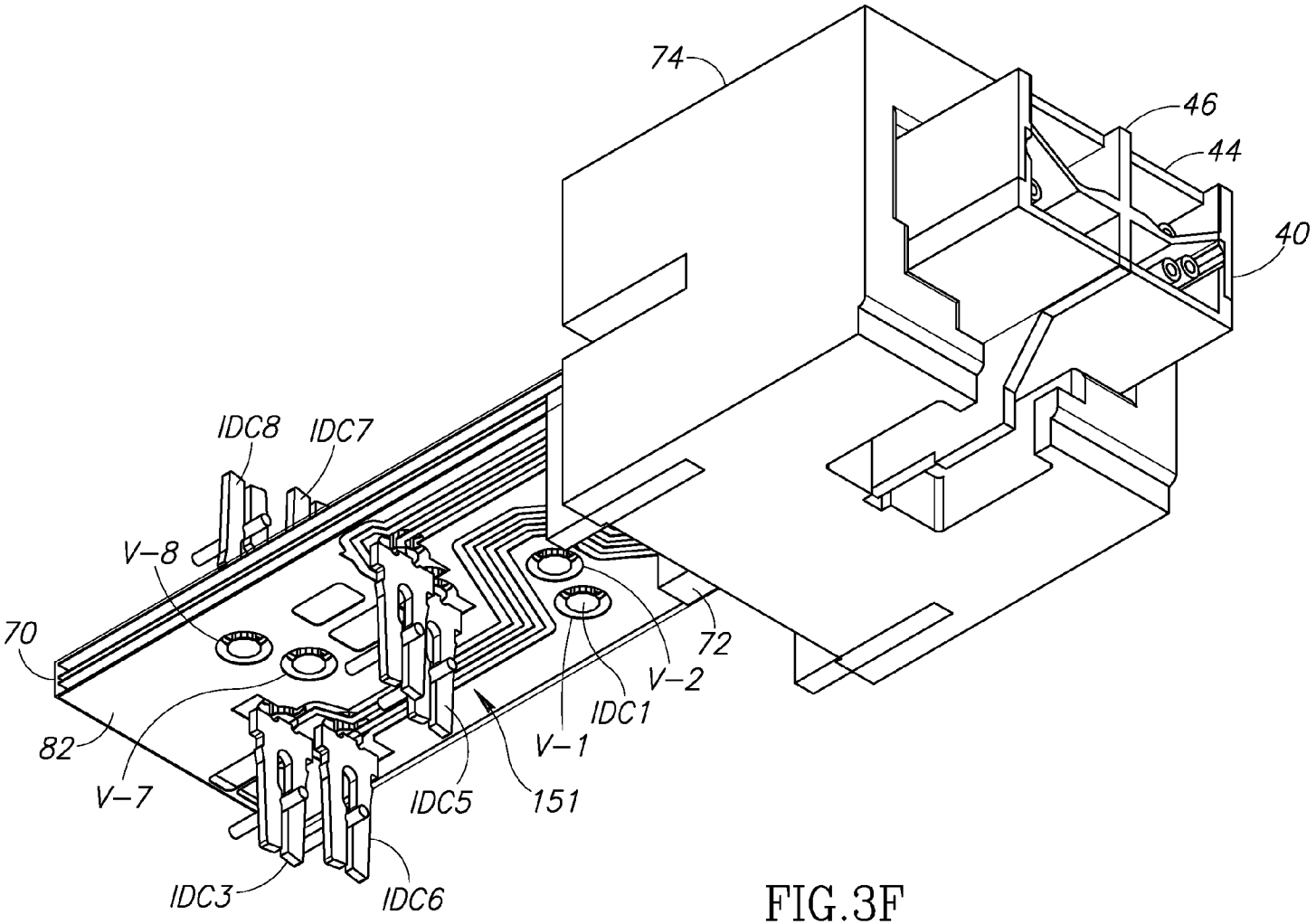
FIG. 3F is a sixth perspective view of the outlet of FIG. 3A with the plug inserted in the plug insertion end of the outlet.
Figure 4A:
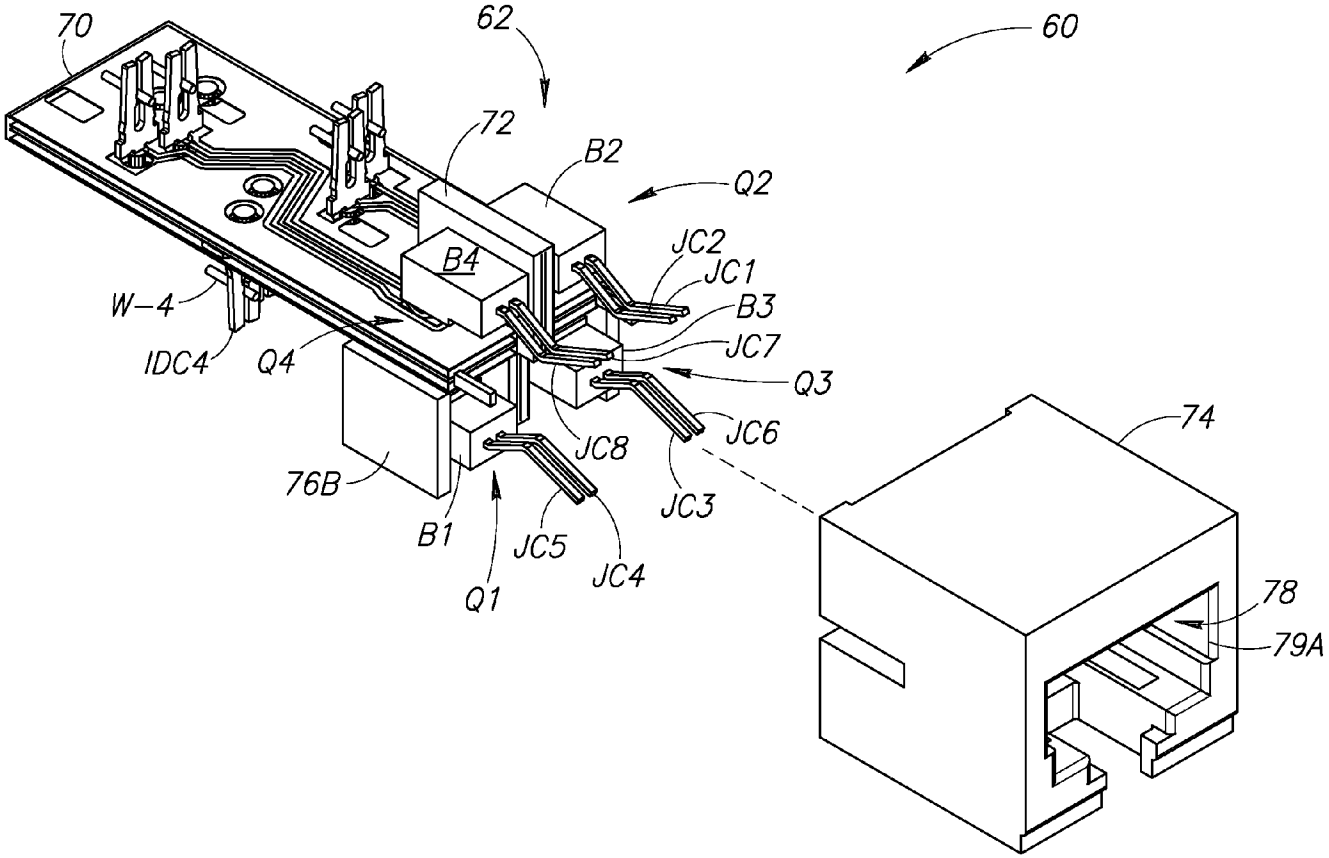
FIG. 4A is a perspective view of the outlet of FIG. 3A with its housing 74 removed.
Figure 4B:
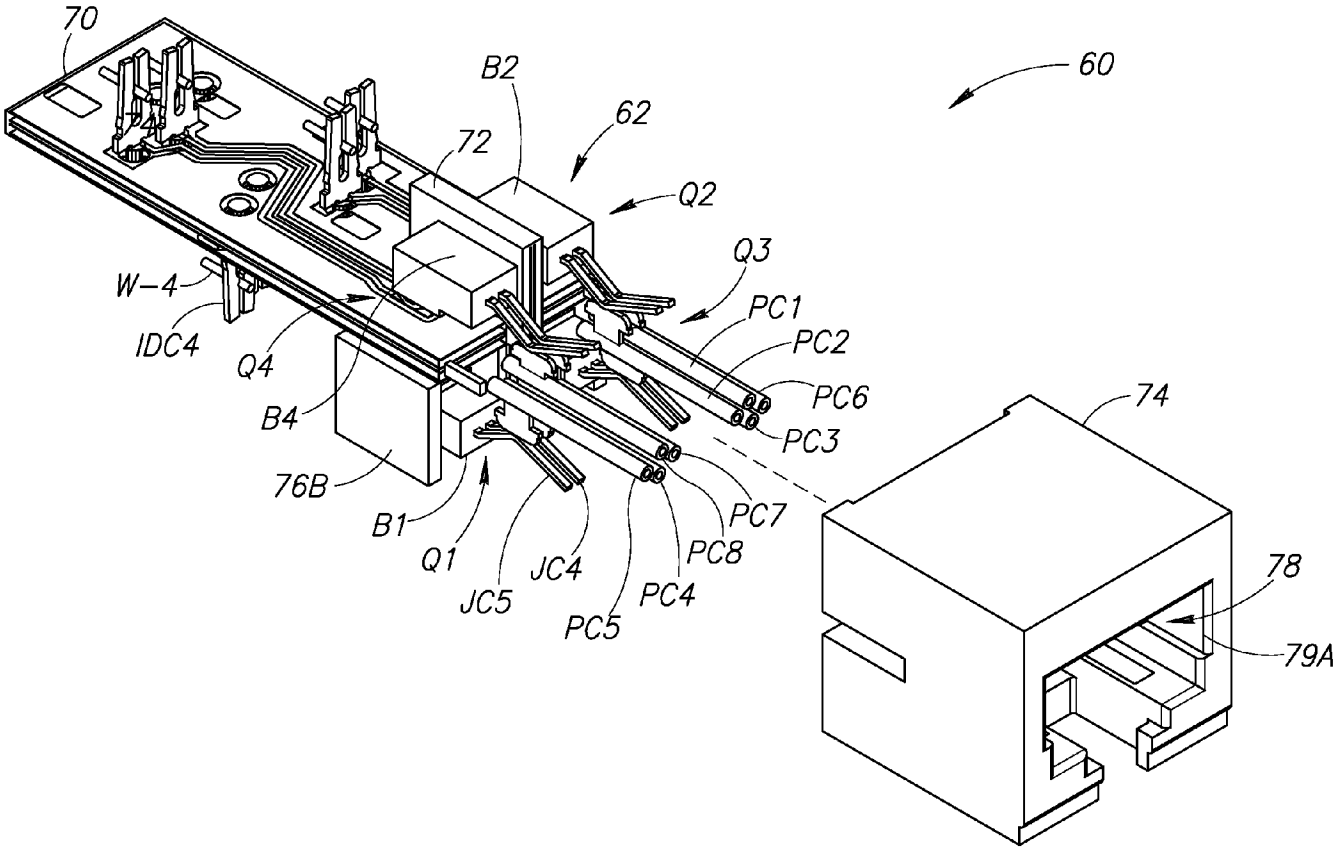
FIG. 4B is a perspective view of the outlet of FIG. 3A with its housing 74 removed and plug contacts in contact with its outlet contacts.

FIGS. 4A and 4B illustrate the outlet 60 with the housing 74 removed therefrom to show the various subcomponents of plug interface assembly 62 including outlet contacts "JC1" to "JC8." FIG. 4B illustrates the outlet contacts "JC1" to "JC8" in contact with the plug contacts "PC1" to "PC8," respectively. While the plug contacts "PC1" to "PC8" of the plug 40 (see FIGS. 2 and 3C-3F) are illustrated in FIG. 4B, the plug housing 44 (see FIGS. 3C-3F) and the plug shield 46 (see FIGS. 3C-3F) have been omitted.

Figure 1:
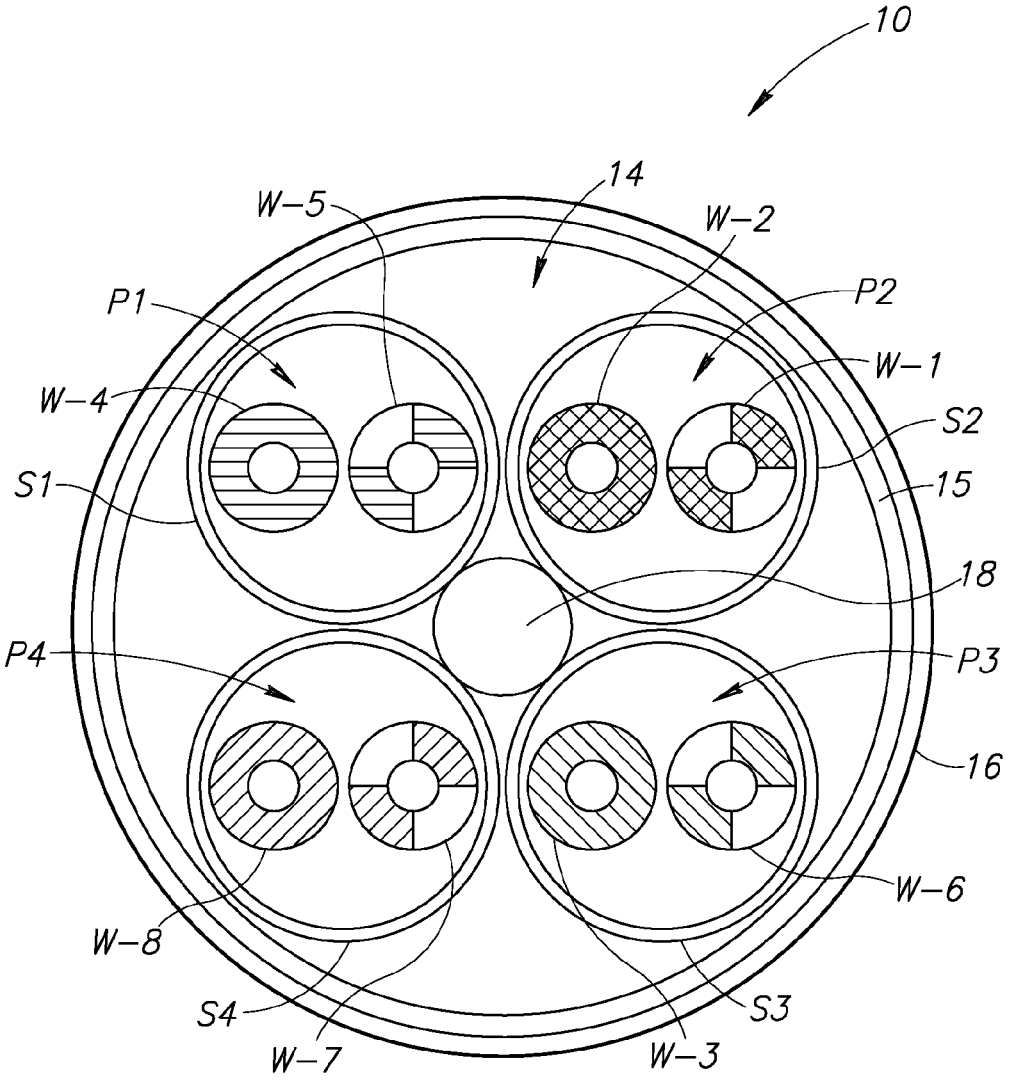
FIG.1 (PRIOR ART)
FIG. 1 is a lateral cross-section of an exemplary Category 7A cable.
Figure 5:
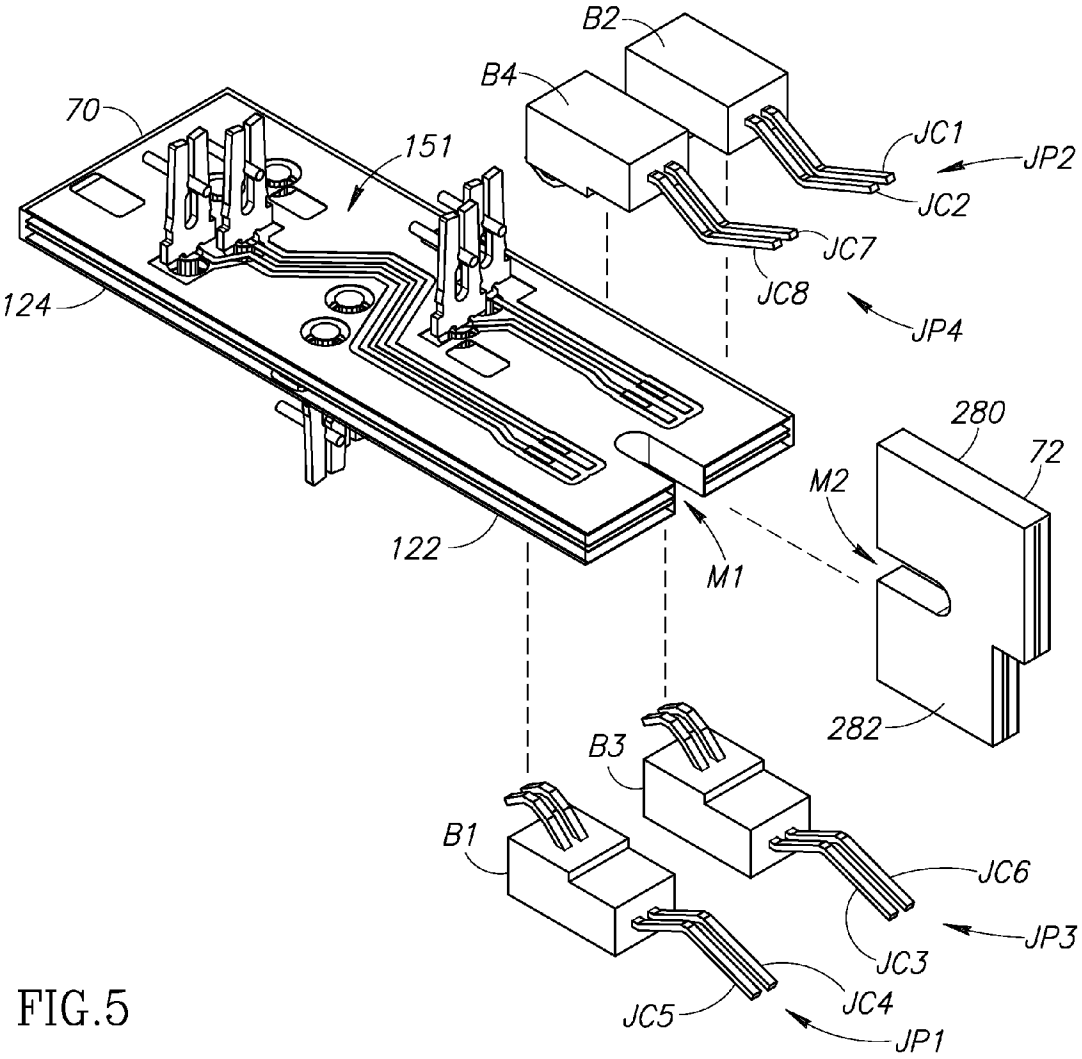
FIG. 5 is a partially exploded perspective view of the outlet of FIG. 3A omitting the housing, support members, and ground contacts.

As may best be viewed in FIG. 5, the plug interface assembly 62 (see FIGS. 4A and 4B) includes a first pair of contacts "JP1" for the twisted-wire pair "P1" (see FIG. 1), a second pair of contacts "JP2" for the twisted-wire pair "P2" (see FIG. 1), a third pair of contacts "JP3" for the twisted-wire pair "P3" (see FIG. 1), and a fourth pair of contacts "JP4" for the twisted-wire pair "P4" (see FIG. 1).

The plug interface assembly 62 (see FIGS. 4A and 4B) may also include additional structures for interfacing with and supporting the horizontal and vertical substrates 70 and 72. For example, referring to FIGS. 3D and 4A, the plug interface assembly 62 may include support members 76A and 76B configured to support the horizontal substrate 70 inside the housing 74. The support members 76A and 76B may be affixed inside the housing 74. Alternatively, the support members 76A and 76B may be integrally formed with the housing 74 as a single unit. The support members 76A and 76B may extend outwardly from the housing 74 at least as far as the vertical substrate 72 extends therefrom to provide additional vertical support for the horizontal substrate 70.

Turning to FIGS. 4A and 5, the first pair of contacts "JP1" (for the twisted-wire pair "P1") may be embedded in a first block "B1" constructed from a non-conductive material. The first block "B1" is received inside the housing 74 (see FIGS. 4A and 4B) and positioned thereby relative to the horizontal and vertical substrates 70 and 72. The first pair of contacts "JP1" includes an outlet contact "JC4" spaced apart from an outlet contact "JC5." Referring to FIG. 4B, the outlet contact "JC4" is positioned to contact the plug contact "PC4" of the plug 40 (see FIGS. 2 and 3C-3F) and the outlet contact "JC5" is positioned to contact the plug contact "PC5" of the plug when the plug is engaged with the plug interface assembly 62.

FIGS. 4A and 5 further show the second pair of contacts "JP2" (for the twisted-wire pair "P2") that may be embedded in a second block "B2" constructed from a non-conductive material. The second block "B2" is received inside the housing 74 (see FIGS. 4A and 4B) and positioned thereby relative to the horizontal and vertical substrates 70 and 72. The second pair of contacts "JP2" includes an outlet contact "JC1" spaced apart from an outlet contact "JC2." The outlet contact "JC1" is positioned to contact the plug contact "PC1" (see FIG. 4B) of the plug 40 (see FIGS. 2 and 3C-3F) and the outlet contact "JC2" is positioned to contact the plug contact "PC2" (see FIG. 4B) of the plug when the plug is engaged with the plug interface assembly 62.

The third pair of contacts "JP3" (for the twisted-wire pair "P3") may be embedded in a third block "B3" constructed from a non-conductive material. The third block "B3" is received inside the housing 74 (see FIGS. 4A and 4B) and positioned thereby relative to the horizontal and vertical substrates 70 and 72. The third pair of contacts "JP3" includes an outlet contact "JC3" spaced apart from an outlet contact "JC6." The outlet contact "JC3" is positioned to contact the plug contact "PC3" (see FIG. 4B) of the plug 40 (see FIGS. 2 and 3C-3F) and the outlet contact "JC6" is positioned to contact the plug contact "PC6" (see FIG. 4B) of the plug when the plug is engaged with the plug interface assembly 62.

The fourth pair of contacts "JP4" (for the twisted-wire pair "P4") may be embedded in a fourth block "B4" constructed from a non-conductive material. The fourth block "B4" is received inside the housing 74 (see FIGS. 4A and 4B) and positioned thereby relative to the horizontal and vertical substrates 70 and 72. The fourth pair of contacts "JP4" includes an outlet contact "JC7" spaced apart from an outlet contact "JC8." The outlet contact "JC7" is positioned to contact the plug contact "PC7" (see FIG. 4B) of the plug 40 (see FIGS. 2 and 3C-3F) and the outlet contact "JC8" is positioned to contact the plug contact "PC8" (see FIG. 4B) of the plug when the plug is engaged with the plug interface assembly 62.

The outlet contacts "JC1" to "JC-8" are constructed from an electrically conductive material and may be substantially identical to one another.

Referring to FIGS. 4A and 4B, the housing 74 includes an open ended channel 78 having a first opening 79A and a second opening 79B (see FIG. 6) opposite the first opening 79A. The first opening 79A is configured to receive the plug 40 and position the plug such that the plug contacts "PC1" to "PC8" engage the outlet contacts "JC1" to "JC8," respectively.

Figure 6:
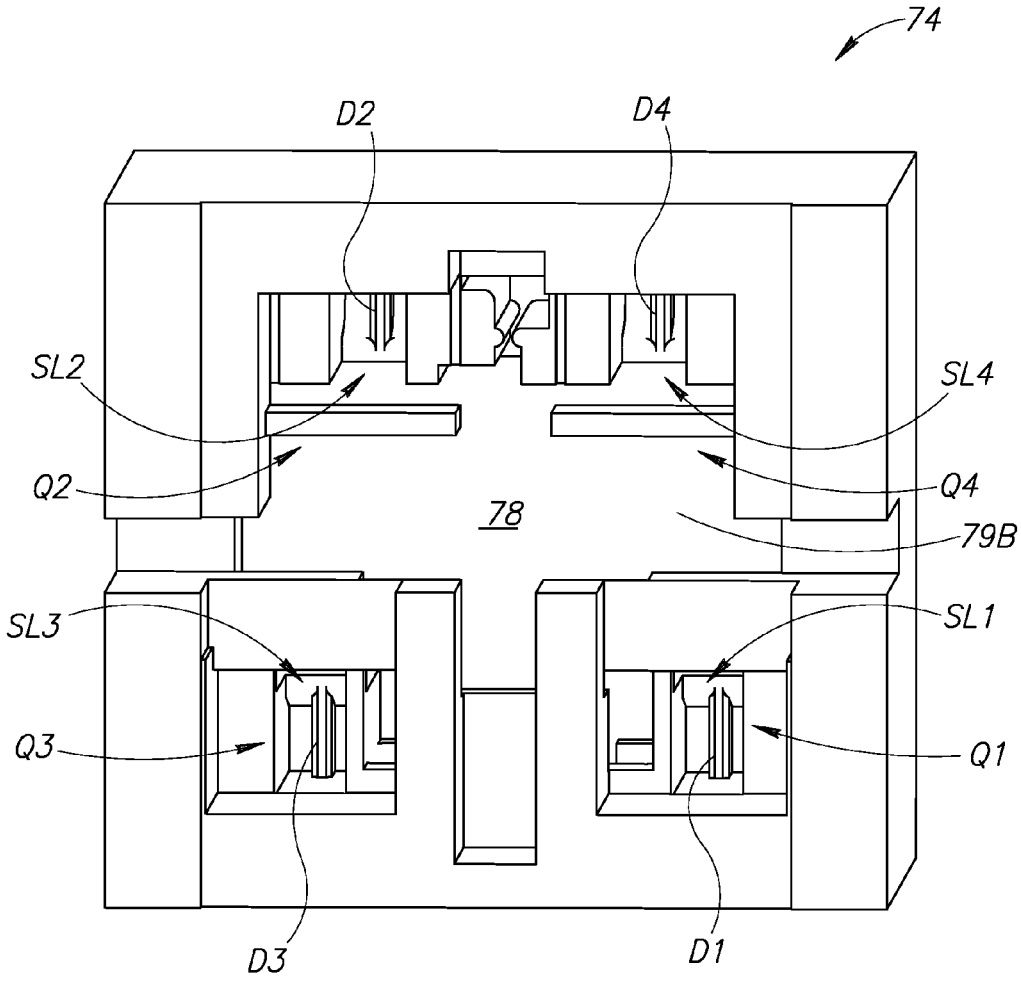
FIG. 6 is a perspective view of the plug-entry side of the housing of the outlet of FIG. 3A.

Referring to FIG. 6, the second opening 79B is configured to receive at least a portion of the horizontal and vertical substrates 70 and 72 (see FIGS. 4A and 4B). Referring to FIGS. 4A and 4B, to improve shielding, the housing 74 may be configured to position the horizontal and vertical substrates 70 and 72 in close proximity with the plug 40 (particularly the plug shield 46 best seen in FIGS. 3D, 3F, and 7) inside the channel 78. The horizontal and vertical substrates 70 and 72 may be characterized as dividing the second opening 79B (see FIG. 6) and at least a portion of the channel 78 into regions "Q1," "Q2," "Q3," and "Q4" as depicted in FIGS. 4B and 6. When the plug 40 is received inside the outlet 60, the region "A1" of the plug is adjacent the region "Q1" of the outlet, the region "A2" of the plug is adjacent the region "Q2" of the outlet, the region "A3" of the plug is adjacent the region "Q3" of the outlet, and the region "A4" of the plug is adjacent the region "Q4" of the outlet.

To shield the signals carried by the twisted-wire pairs "P1" to "P4" from one another, the first block "B1" is positioned inside the first region "Q1," the second block "B2" is positioned inside the second region "Q2," the third block "B3" is positioned inside the third region "Q3," and the fourth block "B4" is positioned inside the fourth region "Q4" (see FIG. 4B). Thus, the blocks "B1" to "B4" are isolated from one another by the horizontal and vertical substrates 70 and 72.

Turning to FIG. 6, the housing 74 includes contact receiving slots "SL1" to "SL4." The outlet contacts "JC4" and "JC5" (see FIG. 5) embedded in the first block "B1" (see FIGS. 4A and 4B) extend therefrom toward the first opening 79A (see FIGS. 4A and 4B) in the channel 78 within the first contact receiving slot "SL1" when the first block "B1" is positioned in the first region "Q1" (see FIG. 5) inside the housing 74. The outlet contacts "JC4" and "JC5" may flex and/or deflect within the first contact receiving slot "SL1" when engaging the plug contacts "PC4" and "PC5" (see FIG. 4B), respectively. The first contact receiving slot "SL1" may include a divider "D1" positioned to separate the outlet contacts "JC4" and "JC5" from one another.

The outlet contacts "JC1" and "JC2" (see FIG. 5) embedded in the second block "B2" (see FIGS. 4A and 4B) extend therefrom toward the first opening 79A (see FIGS. 4A and 4B) in the channel 78 within the second contact receiving slot "SL2" when the second block "B2" is positioned in the second region "Q2" (see FIG. 5) inside the housing 74. The outlet contacts "JC1" and "JC2" may flex and/or deflect within the second contact receiving slot "SL2" when engaging the plug contacts "PC1" and "PC2" (see FIG. 4B), respectively. The second contact receiving slot "SL2" may include a divider "D2" positioned to separate the outlet contacts "JC1" and "JC2" from one another.

The outlet contacts "JC3" and "JC6" (see FIG. 5) embedded in the third block "B3" (see FIGS. 4A and 4B) extend therefrom toward the first opening 79A (see FIGS. 4A and 4B) in the channel 78 within the third contact receiving slot "SL3" when the third block "B3" is positioned in the third region "Q3" (see FIG. 5) inside the housing 74. The outlet contacts "JC3" and "JC6" may flex and/or deflect within the third contact receiving slot "SL3" when engaging the plug contacts "PC3" and "PC6" (see FIG. 4B), respectively. The third contact receiving slot "SL3" may include a divider "D3" positioned to separate the outlet contacts "JC3" and "JC6" from one another.

The outlet contacts "JC7" and "JC8" (see FIG. 5) embedded in the fourth block "B4" (see FIGS. 4A and 4B) extend therefrom toward the first opening 79A (see FIGS. 4A and 4B) in the channel 78 within the fourth contact receiving slot "SL4" when the fourth block "B4" is positioned in the fourth region "Q4" (see FIG. 5) inside the housing 74. The outlet contacts "JC7" and "JC8" may flex and/or deflect within the fourth contact receiving slot "SL4" when engaging the plug contacts "PC7" and "PC8" (see FIG. 4B), respectively. The fourth contact receiving slot "SL4" may include a divider "D4" positioned to separate the outlet contacts "JC7" and "JC8" from one another.

Figure 7:
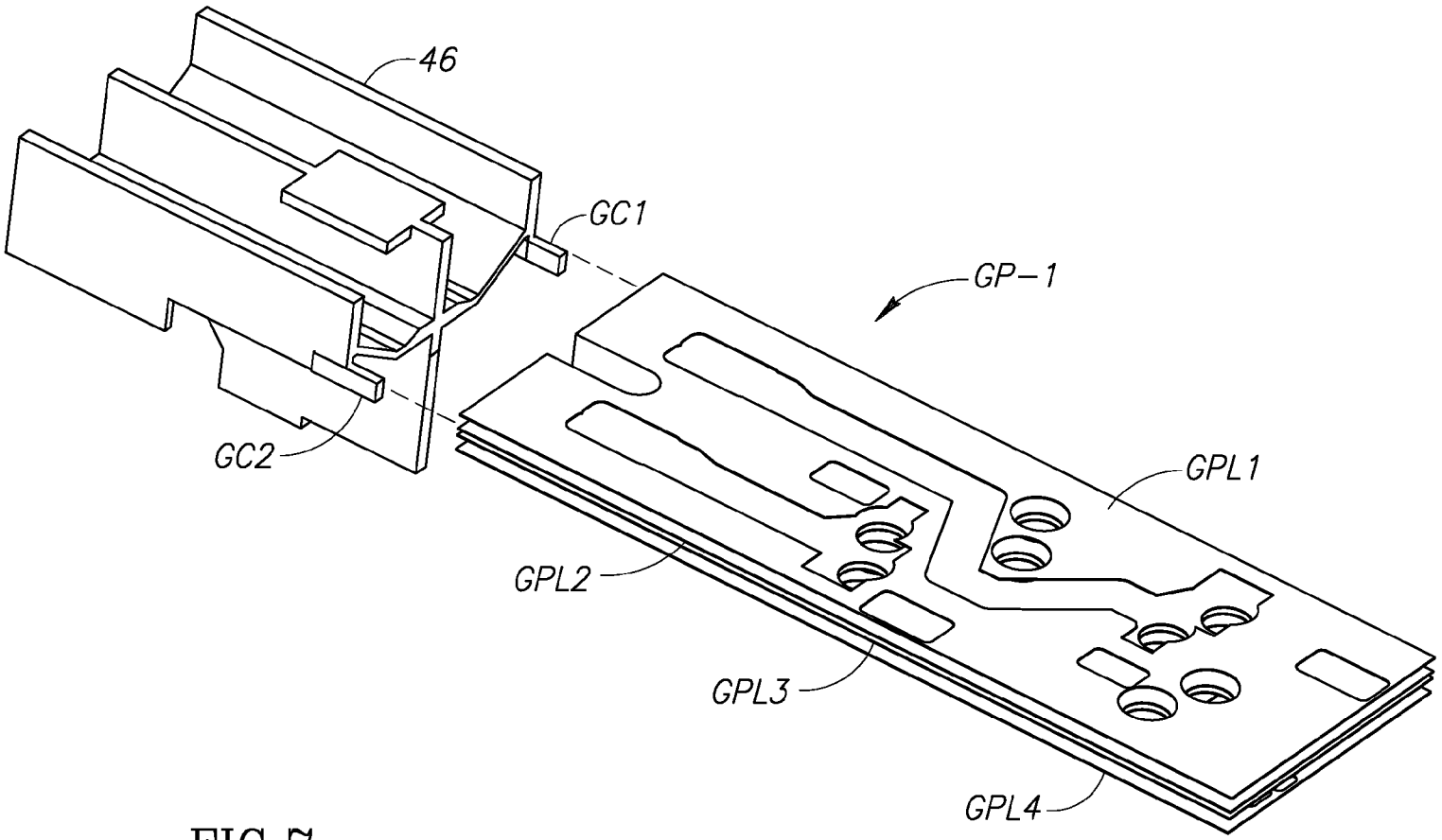
FIG. 7 is an exploded perspective view of a first ground plane and ground contacts of the outlet of FIG. 3A and an electrically conductive plug shield of the plug.

Referring to FIG. 7, in embodiments in which the housing 74 is constructed from a non-conductive material, the plug interface assembly 62 (see FIGS. 4A and 4B) may include one or more ground contacts (e.g., ground contacts "GC1" and "GC2") positioned to connect ground components of the outlet 60 to ground components (e.g., the plug shield 46) of the plug 40 across the plug-outlet interface. Thus, the one or more ground contacts (e.g., ground contacts "GC1" and "GC2") effect a ground connection across the outlet-plug interface. As will be explained below, the one or more ground contacts may connect ground components of the horizontal and vertical substrates 70 and 72 to corresponding ground components (e.g., the plug shield 46) of the plug 40.

Horizontal Substrate 70

Figure 8:
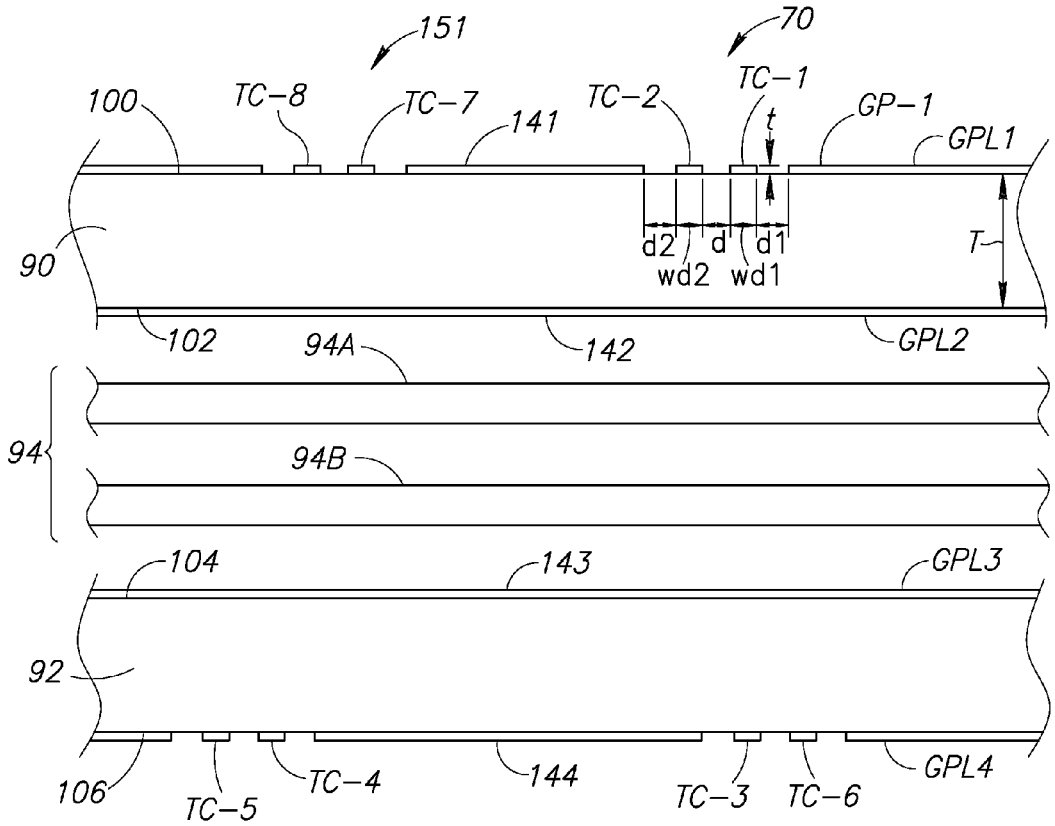
FIG. 8 is a cross-section of a portion of a horizontal substrate of the outlet of FIG. 3A viewed at a particular location that includes a circuit and the first ground plane.

The horizontal substrate 70 has a first side 80 (see FIG. 3A) opposite a second side 82 (see FIG. 3B). Turning to FIG. 8, the horizontal substrate 70 includes a first substrate layer 90 and a second substrate layer 92 with an insulating layer 94 positioned between the first and second substrate layers. By way of a non-limiting example, the first and second substrate layers 90 and 92 may be constructed from a conventional core material used to construct conventional printed circuit boards and the insulating layer 94 may be constructed from a pre-impregnated material used to construct conventional printed circuit boards commonly referred to as "prepreg." By way of a non-limiting example, the insulating layer 94 may include a first insulating layer 94A adjacent the first layer 90 and a second insulating layer 94B adjacent the second layer 92.

The first layer 90 has a first surface 100 opposite a second surface 102 and the second layer 92 has a first surface 104 opposite a second surface 106. The second surface 102 of the first layer 90 is adjacent the insulating layer 94 and the first surface 104 of the second layer 92 is adjacent the insulating layer 94.

The first and second layers 90 and 92 (see FIG. 8) have a circuit 151 (described below) positioned thereupon. Turning to FIG. 5, the substrate 70 includes a first end portion 122 for engaging with the outlet contacts "JC1" to "JC8." On the first end portion 122, the outlet contacts "JC1" to "JC8" are connected to the circuit 151.

The substrate 70 is configured to terminate the cable 10 (see FIG. 1). For ease of illustration, in FIGS. 3A-3F, 4A, 4B, and 5, only the wires "W-1" to "W-8" of the cable 10 have been illustrated. The cable 10 may be attached to a second end portion 124 of the substrate 70 opposite the first end portion 122. For example, the second end portion 124 of the substrate 70 may include a pair of spaced apart through-holes (not shown) configured to permit a conventional cable tie (not shown) to pass therethrough to bind the cable 10 (see FIG. 1) to the horizontal substrate 70. The pair of spaced apart through-holes (not shown) may be spaced apart from the circuit 151.

Returning to FIG. 8, the horizontal substrate 70 may be conceptualized as including four layers of various conductive elements. A top layer 141 positioned on the first surface 100 of the first layer 90, a first inner layer 142 positioned on the second surface 102 of the first layer 90, a second inner layer 143 positioned on the first surface 104 of the second layer 92, and a bottom layer 144 positioned on the second surface 106 of the second layer 92. The first surface 80 (see FIG. 3A) of the substrate 70 corresponds to the top layer 141 and the second surface 82 (see FIG. 3B) of the substrate 70 corresponds to the bottom layer 144. As is apparent to those of ordinary skill in the art, the assignment of the terms "top" and "bottom" to the layers 141 and 144, respectively, is arbitrary and not intended to be limiting.

Elements including or constructed from conductive material (e.g., traces, printed wires, lands, pads, planes, and the like) are categorized herein in two groups. The first group includes signal carrying conductive path elements (e.g., traces, printed wires, and the like), which may be connected to various ancillary conductive elements and are referred to collectively as "conductive elements." The circuit 151 includes conductive elements belonging to the first group.

The second group includes specialized conductive elements that may be connected together to form an overall ground plane structure for the outlet. These elements may include sections of copper traces on various layers of the various printed circuit boards which make up the outlet, an electrical conductive housing (if present), as well as other conductive elements that make up the outlet.

Portions of the ground plane structure within the outlet are used to help contain energy radiated from associated portions of the first group of conductors described above and prevent said energy from being picked up by other portions of the first group. Furthermore, the overall ground plane structure of the outlet, which includes the aforementioned portions of the ground plane, is used to contain electrical energy that might otherwise be radiated out of the outlet.

The overall ground plane of the outlets may be implemented as a localized, electrically floating, isolated ground plane ("LEFIGP") in which case it is not electrically connect with any other ground plane structures within the system (other than perhaps the plug to which it is mated), or can be electrically connected to all other ground plane structures throughout the cabling system including those contained within an associated cable.

Specifically, the horizontal substrate 70 includes at least a portion of ground plane "GP-1." The ground plane "GP-1" illustrated is implemented as a LEFIGP. However, the ground plane "GP-1" may be electrically connected to similar corresponding structures on adjacent mated substrates (e.g., the vertical substrate 72) and/or additional local shield elements such as those that may be used to shield the individual outlets 20 (illustrated in FIG. 2).

The ground plane "GP-1" is disconnected from the conductive elements (e.g., traces) of the circuit 151. However, the ground plane "GP-1" is positioned relative to the circuit 151 to receive energy radiated outwardly from the conductive elements of the circuit 151. For example, the ground plane "GP-1" may be positioned in close proximity to the circuit 151 to receive energy radiated outwardly from the conductive elements of the circuit 151.

When elements including or constructed from conductive material (e.g., the conductive elements of a circuit or ground plane) are positioned on different layers, they may be interconnected by vertically oriented conductive elements, such as vertical interconnect accesses ("VIAs") (e.g., VIA "V-1" to "V-8"). See, e.g., FIGS. 3B, 3E, 3F, 11A.

In a conventional communication connector (not shown), the wires of a cable are typically connected (e.g., soldered) to a circuit on the same side of the substrate. In contrast, returning to FIGS. 3A and 3B, some of the wires "W-1" to "W-8" (see FIG. 2) of the cables 10 are connected to the circuit 151, respectively, on the first side 80 of the substrate 70 and some of the wires of the cable are connected to the circuit on the second side 82 of the substrate. Thus, the wires "W-1" to "W-8" straddle or flank the second end portion 124 of the horizontal substrate 70. In the embodiment illustrated, the twisted-wire pairs "P2" and "P4" are connected to the first side 80 of the horizontal substrate 70 (which corresponds to the top layer 141) and the twisted-wire pairs "P1" and "P3" are connected to the second side 82 of the horizontal substrate 70 (which corresponds to the bottom layer 144). See FIGS. 1, 3A, 3D, and 5.

The wires "W1" to "W8" of the cable 10 may be soldered to the circuit 151. Alternatively, returning to FIGS. 3A and 3D, insulation displacement connectors "IDC1" to "IDC8" may be used to form electrical connections between the wires "W1" to "W8" of the cable 10 (see FIG. 2) and the circuit 151. Turning to FIGS. 3A and 3C, the insulation displacement connectors "IDC1," "IDC2," "IDC7," and "IDC8" may be connected to the circuit 151 by inserting them into the VIAs "V-1," "V-2," "V-7," and "V-8" (see FIG. 3B), respectively, on the first side 80 of the horizontal substrate 70. The insulation displacement connectors "IDC4," "IDC5," "IDC3," and "IDC6" may be connected to the circuit 151 by inserting them into the VIAs "V-4," "V-5," "V-3," and "V-6" (see FIG. 3E), respectively, on the second side 82 of the horizontal substrate 70.

On the first side 80 of the horizontal substrate 70, the insulation displacement connectors "IDC1" and "IDC2" are offset from the insulation displacement connectors "IDC7" and "IDC8." On the second side 82 of the horizontal substrate 70, the insulation displacement connectors "IDC4" and "IDC5" are offset from the insulation displacement connectors "IDC3" and "IDC6." Further, the insulation displacement connectors "IDC1," "IDC2," "IDC7," and "IDC8" on the first side 80 of the horizontal substrate 70 are offset from the insulation displacement connectors "IDC4," "IDC5," "IDC3," and "IDC6" on the second side 82 of the horizontal substrate 70.

Referring to FIG. 7, the ground plane "GP-1" has four different layers "GPL1," "GPL2," "GPL3," and "GPL4" (see FIGS. 10A-10D). Referring to FIG. 8, the first ground plane layer "GPL1" is positioned on the first surface 100 of the first layer 90 and is part of the top layer 141 of conductive components. The second ground plane layer "GPL2" is positioned on the second surface 102 of the first layer 90 and is part of the first inner layer 142 of conductive components. The third ground plane layer "GPL3" is positioned on the first surface 104 of the second layer 92 and is part of the second inner layer 143 of conductive components. The fourth ground plane layer "GPL4" is positioned on the second surface 106 of the second layer 92 and is part of the bottom layer 144 of conductive components.

Figure 11A:
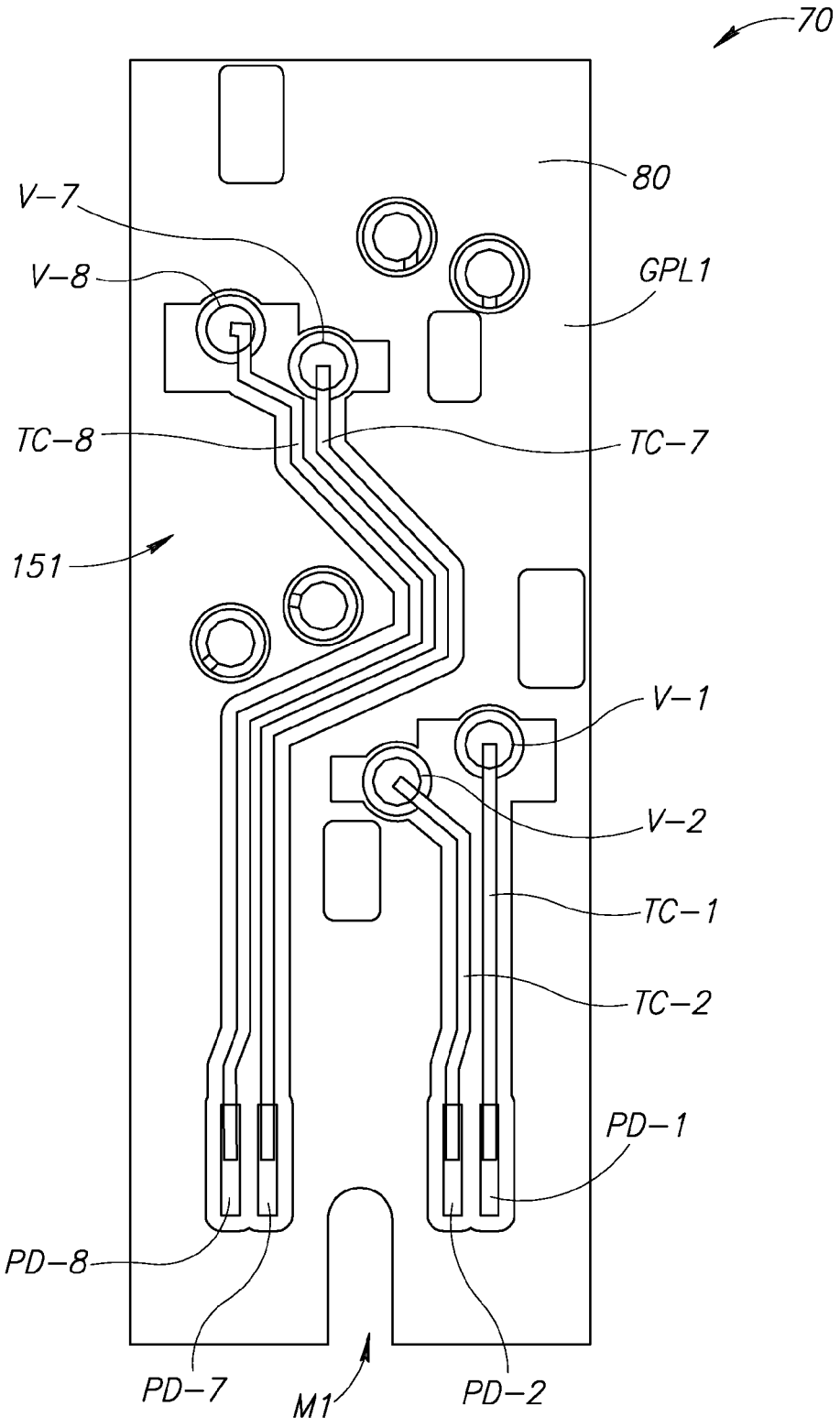
FIG. 11A is a view of a first side of the horizontal substrate and circuit of FIG. 8.
Figure 11B:
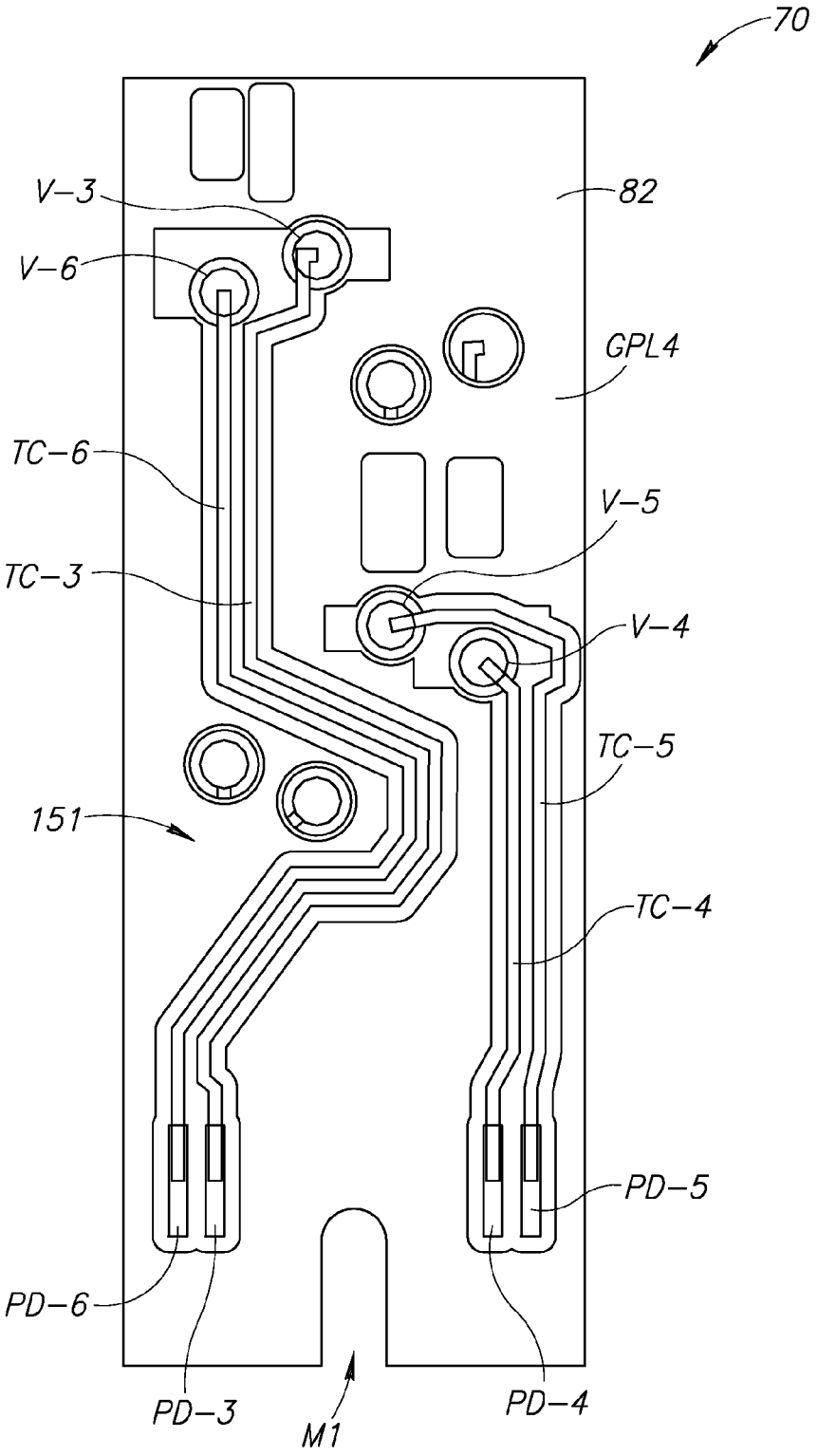
FIG. 11B is a view of a second side the horizontal substrate and circuit of FIG. 8.

Referring to FIGS. 11A and 11B, the circuit 151 includes conductive elements (e.g., traces "TC-1" to "TC-8"). These conductive elements may be arranged in pairs (e.g., a first pair of conductive elements "TC-4" and "TC-5," a second pair of conductive elements "TC-1" and "TC-2," a third pair of conductive elements "TC-3" and "TC-6," and a fourth pair of conductive elements "TC-7" and "TC-8"). The ground plane "GP-1" is positioned in close proximity to the conductive elements of the circuit 151 to contain electromagnetic fields within the associated circuit by providing a localized common ground to which energy can be conveyed rather than radiated outwardly to other conductors within the circuit itself and/or surrounding circuits.

It is often desirable to have the impedance-to-ground of one conductive element of a pair of conductive elements substantially equal to the impedance-to-ground of the other conductive element of the pair. This fosters a condition referred to as "balanced to ground," which is known to be the best case condition for minimizing crosstalk between the pair of conductors and other surrounding conductors. The conductive materials that make up the ground plane "GP-1" provide a localized common ground plane for the circuit 151. While the overall impedance-to-ground of any conductive element is influenced by additional factors, (such as the length and thickness of the conductive element), the dimensional relationship between each of the paired conductive elements and the conductive components of the associated ground plane at any particular point along the length of the conductive element may be varied to control the impedance of that conductive element to the localized common ground at that particular point. By controlling this impedance along the length of a pair of conductive elements, the overall common mode impedance of the pair may be controlled. In addition, the differential mode impedance of a pair of conductive elements may also be controlled at any point along the length of the pair by varying these impedances; however, this impedance is also influenced significantly by the dimensional relationship between the two paired conductive elements.

FIG. 8 illustrates a cross-section of a portion of the horizontal substrate 70 at a particular location that includes the circuit 151 and the ground plane "GP-1." The circuit 151 includes a pair of conductive elements, e.g., traces "TC-1" and "TC-2," positioned on the top layer 141. The top layer 141 is on the first substrate layer 90, which has a thickness "T." As illustrated in FIG. 8, at this particular location, the traces "TC-1" and "TC-2" are spaced apart by a distance "d." The trace "TC-1" has a width "wd1" and is spaced apart from an adjacent portion of the ground plane "GP-1" by a distance "d1." The trace "TC-2" has a width "wd2" and is spaced apart from an adjacent portion of the ground plane "GP-1" by a distance "d2."

By way of a non-limiting example, the traces "TC-1" and "TC-2," and the ground plane "GP-1" will be used to explain the relationship between a pair of conductive elements, in this case the traces "TC-1" and "TC-2," and their associated ground plane "GP-1." However it is understood that the same general relationship applies to any of the other pairs of conductive elements in the circuit 151 and the ground plane "GP-1."

Figure 9:
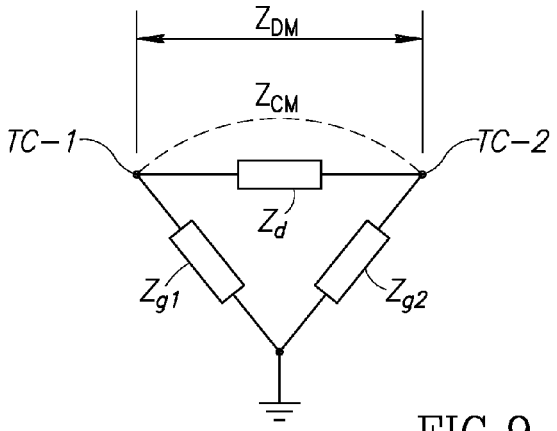
FIG. 9 is an electrical diagram modeling impedances associated with a pair of traces of the circuit of FIG. 8.
Figures 10A, 10B, 10C, 10D:
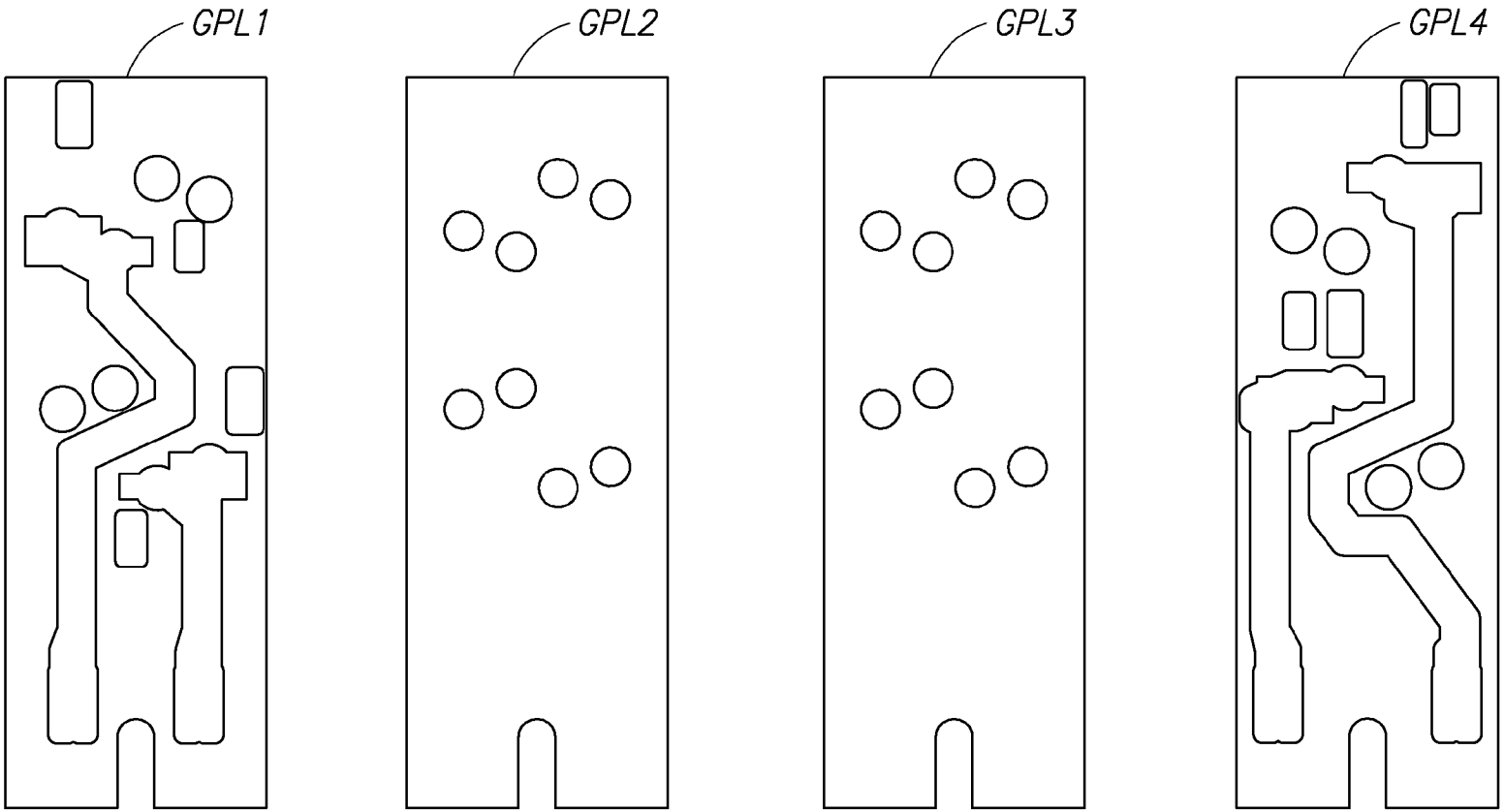
FIG. 10A is a top view of a first layer of the first ground plane of FIG. 7.
FIG. 10B is a top view of a second layer of the first ground plane of FIG. 7.
FIG. 10C is a top view of a third layer of the first ground plane of FIG. 7.
FIG. 10D is a top view of a fourth layer of the first ground plane of FIG. 7.

FIG. 9 is an electrical diagram modeling the impedances associated with the traces "TC-1" and "TC-2." Impedance "$Z_d$" is the impedance between the traces "TC-1" and "TC-2." Impedance "$Z_{g1}$" is the impedance between the trace "TC-1" and ground (also referred to as the impedance to ground). Impedance "$Z_{g2}$" is the impedance between the trace "TC-2" and ground (also referred to as the impedance to ground). As explained above, it may be desirable for impedances "$Z_{g1}$" and "$Z_{g2}$" to be substantially equal to one another.

Two impedances that are important for properly matching a connector (e.g., the outlet 60) to a system (not shown) within which the connector is to be utilized are differential mode impedance "$Z_{DM}$," and common mode impedance "$Z_{CM}$" For a balanced transmission system, these impedances are a function of the impedances "$Z_d$," "$Z_{g1}$," and "$Z_{g2}$" and can be calculated using the following equations:

$$Z_{DM} = \frac{Z_d(Z_{g1} + Z_{g2})}{(Z_d + Z_{g1} + Z_{g2})}$$

$$Z_{CM} = \frac{Z_{g1} * Z_{g2}}{Z_{g1} + Z_{g2}}$$

In addition, a percentage "$Z_{cmUNBAL}$," which is a measure of the inequality of the two common mode impedances "$Z_{g1}$" and "$Z_{g2}$," can be calculated using the following equation:

$$Z_{cmUNBAL} = \frac{|Z_{g1} - Z_{g2}|}{(Z_{g1} + Z_{g2})/2} * 100$$

Thus, the impedance "$Z_{CM}$" and the percentage "$Z_{cmUNBAL}$" may each be determined as a function of the impedances "$Z_{g1}$" and "$Z_{g2}$." The impedance "$Z_{DM}$" may be determined as a function of impedances "$Z_d$," "$Z_{g1}$," and "$Z_{g2}$." Furthermore, each of these impedances may be considered at either one specific point along the length of the pair of traces "TC-1" and "TC-2," or as an overall average impedance representative of the entire length of the traces.

Once a specific substrate is chosen for the first and second substrate layers 90 and 92, having a specific dielectric constant "e," and thickness "T," and a path thickness "t," and lengths of the traces "TC-1" and "TC-2" are chosen, the overall average value of the impedance "$Z_d$" between the traces "TC-1" and "TC-2," may be determined primarily as a function of the average value of the widths "wd1" and "wd2" and the average value of the distance "d" along the length of the pair of traces. Furthermore, the overall average value of the impedance "$Z_{g1}$" between the trace "TC-1" and ground may be determined primarily as a function of the average value of the width "wd1," and the average value of the distance "d1" along the length of trace "TC-1." Likewise, the overall average value of the impedance "$Z_{g2}$" between the trace "TC-2" and ground may be determined primarily as a function of the average value of the width "wd2" and the average value of the distance "d2" along the length of trace "TC-2".

The values of the distance "d1" and the width "wd1" may be adjusted at any point along the length of one of a pair of conductive elements (such as the trace "TC-1") to adjust for anomalies in the impedance "$Z_{g1}$" elsewhere along the conductive element such that overall average impedance "$Z_{g1}$" remains substantially equal to the overall average impedance "$Z_{g2}$." Likewise, the values for distance "d2" and the width "wd2" may be adjusted at any point along the length of the other of the pair of conductive elements (such as the trace "TC-2") to adjust for anomalies in the impedance "$Z_{g2}$" elsewhere along the conductive element, such that overall impedance "$Z_{g2}$" remains substantially equal to the overall average impedance "$Z_{g1}$."

While the general relationship between the physical and electrical properties of individual segments of the conductive elements with specific dimensional relationships to other conductive elements, including conventional ground elements, are well understood by those of ordinary skill in the art, in the specific case of the complex circuits presented here, (which include traces having continuously varying physical relationships to other conductive elements, ground planes, and ancillary electrically conductive elements as defined previously herein), an electrical performance analysis of the circuits may be accomplished through a successive process of electro-magnetic field simulation, circuit fabrication, and testing. This electrical performance analysis may be used to determine final values of the various parameters (e.g., the substrate material, the thickness "T," the width "wd1," the width "wd2," the distance "d," the distance "d1," the distance "d2," an average conductive element length, the path thickness "t," and the like) used to construct the conductive elements of the circuit 151 and the ground plane "GP-1."

Once the overall average values of the impedances "$Z_d$," "$Z_{g1}$," and "$Z_{g2}$" are established, the overall average values for the differential mode impedance "$Z_{DM}$," the common mode impedance "$Z_{CM}$," and the percentage "$Z_{cmUNBAL}$" may be calculated using the equations above. Such parameters may also be empirically determined using appropriate test methods.

It is desirable to design the aforementioned physical and electrical characteristics of the conductive elements, such as the traces "TC-1" and "TC-2," and the horizontal substrate 70, such that the overall average values for the differential mode impedance "$Z_{DM}$," and the common mode impedance "$Z_{CM}$" for the conductive element pairs equal the differential mode impedance and the common mode impedance, respectively, of the system (not shown) in which the connector (e.g., the outlet 60) incorporating the horizontal substrate 70 is intended to be used.

Values for the conductive element widths "wd1" and "wd2" and the distances "d1" and "d2" may be adjusted at any point along the length of the conductive elements (e.g., the traces "TC-1" and "TC-2") such that the overall average value of the common mode impedance "$Z_{CM}$" of the conductive elements is substantially identical to the common mode impedance of a system (not shown) in which the horizontal substrate 70 (e.g., when incorporated into the outlet 60) is intended to be utilized.

At the same time, the effect of each of these values on the overall value of the differential mode impedance "$Z_{DM}$" may be considered. However, for differential mode impedance, the distance "d" also plays a significant role in determining the overall value of the common mode impedance "$Z_{CM}$" of the traces "TC-1" and "TC-2." Therefore, in the case of the differential mode impedance "$Z_{DM}$," the values of the widths "wd1" and "wd2" and the distances "d," "d1," and "d2" may be adjusted at any point along the length of the traces "TC-1" and "TC-2," such that the overall value of the differential mode impedance "$Z_{DM}$" of the pair of traces is substantially equal to the differential mode impedance of the system (not shown) in which the horizontal substrate 70 (e.g., when incorporated into the outlet 60) is intended to be utilized.

The values of the widths "wd1" and "wd2" and the distances "d," "d1," and "d2" may be selected such that the overall value of the differential mode impedance "$Z_{DM}$" for the traces "TC-1" and "TC-2," (and optionally one or more other pairs of conductors positioned on the first substrate layer 90) is equal to the system impedance of a system (not shown) for which the horizontal substrate 70 (e.g., when incorporated into the outlet 60) is intended to be utilized. At the same time, the effect of each of these values on the overall value of the common mode impedance "$Z_{CM}$" may also be considered. This relationship is understood by those of ordinary skill in the art and will not be described in detail.

The exact values for the widths "wd1" and "wd2" and the distances "d," "d1," and "d2" may be adjusted at any point along the length of the conductive elements (e.g., the traces "TC-1" and "TC-2") to adjust for anomalies in the differential mode impedance "$Z_{DM}$" elsewhere along the conductive elements or related to other conductive elements associated therewith, such that the average overall value of the differential mode impedance "$Z_{DM}$" for the pair of conductive elements equals the differential mode impedances of a system (not shown) in which the horizontal substrate 70 (e.g., when incorporated into the outlet 60) is intended to be utilized.

At the same time, it is also desirable to design the aforementioned physical and electrical characteristics of the conductive elements (e.g., the traces "TC-1" and "TC-2") and the horizontal substrate 70, such that the overall average value of the impedance "$Z_{g1}$," and the overall average value of the impedance "$Z_{g2}$" are approximately equal to minimize the percentage "$Z_{cmUNBAL}$. In addition, the overall value of the common mode impedance unbalance percentage "$Z_{cmUNBAL}$" for the conductive elements (such as the traces "TC-1" and "TC-2") may be adjusted by modifying the average values of the impedance "$Z_{g1}$," which may be accomplished by adjusting the average values of distance "d1" and the width "wd1." Likewise, the average values of the impedance "$Z_{g2}$" may be modified by adjusting the average values of the distance "d2" and the width "wd2."

The values of the distance "d1" and the width "wd1" may be adjusted at any point along the length of one of a pair of conductive elements (such as the trace "TC-1") to adjust for anomalies in the impedance "$Z_{g1}$" elsewhere along the conductive element such that overall average impedance "$Z_{g1}$" remains substantially equal to the overall average impedance "$Z_{g2}$." Likewise, the values for distance "d2" and the width "wd2" may be adjusted at any point along the length of the other of the pair of conductive elements (such as the trace "TC-2") to adjust for anomalies in the impedance "$Z_{g2}$" elsewhere along the conductive element, such that overall impedance "$Z_{g2}$" remains substantially equal to the overall average impedance "$Z_{g1}$."

While the general relationship between the physical and electrical properties of individual segments of the conductive elements with specific dimensional relationships to other conductive elements, including conventional ground elements, are well understood by those of ordinary skill in the art, in the specific case of the complex circuits presented here, (which include traces having continuously varying physical relationships to other conductive elements, ground planes, and ancillary electrically conductive elements as defined previously herein) performance analysis of the circuits may be accomplished through a successive process of electro-magnetic field simulation, circuit fabrication, and testing. This analyses may be used to determine final values of the various parameters (e.g., the substrate material, the thickness "T," the width "wd1," the width "wd2," the distance "d," the distance "d1," the distance "d2," an average conductive element length, the path thickness "t," and the like) used to construct the conductive elements of the circuit 151 and the ground plane "GP-1."

Referring to FIG. 7, the layers "GPL1" to "GPL4" are substantially aligned with one another. The ground plane "GP-1" includes conductive material positioned on the four layers "GPL1" to "GPL4" that may be interconnected by the VIAs (not shown). In the embodiment illustrated in FIG. 5, the horizontal substrate 70 and the ground plane "GP-1" have a slot "M1" formed therein. The slot "M1" is formed in the first end portion 122 of the horizontal substrate 70. At least a portion of the slot "M1" is coated (or plated) with an electrically conductive material that interconnects the layers "GPL1" to "GPL4." The slot "M1" is configured to mate with a corresponding slot "M2" formed in the vertical substrate 72 and form an electrical connection therewith.

The drain wire 18 and/or the shield 15 (see FIG. 1) of the cable 10 may be connected to the ground plane "GP-1." Optionally, an insulation displacement connector (not shown) may be electrically connected to the ground plane "GP-1." The drain wire 18 and/or the shield 15 of the cable 10 (see FIG. 1) may be connected to the insulation displacement connector (not shown).

The shields "S1" to "S4" of the cable 10 may be connected to the ground plane "GP-1." By way of a non-limiting example, the shields "S2" and "S4" may be placed in physical contact with the first ground plane layer "GPL1" and the shields "S1" to "S3" may be placed in physical contact with the fourth ground plane layer "GPL4"

Turning to FIG. 11A, on the first side 80, the substrate 70 includes four contacts "PD-1," "PD-2," "PD-7," and "PD-8" for the circuit 151. The outlet contacts "JC-1," "JC-2," "JC-7," and "JC-8" are positioned (by the housing 74) to contact the contacts "PD-1," "PD-2," "PD-7," and "PD-8," respectively, for the circuit 151.

Turning to FIG. 11B, on the second side 82, the substrate 70 includes four contacts "PD-3," "PD-6," "PD-4," and "PD-5" for the circuit 151. The outlet contacts "JC-3," "JC-6," "JC-4," and "JC-5" are positioned (by the housing 74) to contact the contacts "PD-3," "PD-6," "PD-4," and "PD-5," respectively, for the circuit 151. Optionally, the outlet contacts "JC-1" to "JC-8" may be implemented as self-cleaning contacts configured to scrape across the contacts "PD-1" to "PD-8," respectively, when brought into contact therewith to remove dirt and/or oxidation from the contacts "PD-1" to "PD-8," respectively.

Circuit 151

Turning to FIG. 11A, the wires "W-1" and "W-2" (see FIGS. 3A and 3C) of the twisted-wire pair "P2" of the cable 10 are connected to the VIAs "V-1" and "V-2," respectively, of the circuit 151 (e.g., by the insulation displacement connectors "IDC1" and "IDC2," respectively). On the first side 80, the VIA "V-1" is connected to the contact "PD-1" by the trace "TC-1." Thus, the wire "W-1" of the cable 10 is connected to the contact "PD-1." On the first side 80, the VIA "V-2" is connected to the "PD-2" by the trace "TC-2." Thus, the wire "W-2" of the cable 10 is connected to the contact "PD-2."

The wires "W-7" and "W-8" (see FIGS. 3A and 3C) of the twisted-wire pair "P4" of the cable 10 are connected to the VIAs "V-7" and "V-8," respectively, of the circuit 151 (e.g., by the insulation displacement connectors "IDC7" and "IDC8," respectively). On the first side 80, the VIA "V-7" is connected to the contact "PD-7" by the trace "TC-7." Thus, the wire "W-7" of the cable 10 is connected to the contact "PD-7." On the first side 80, the VIA "V-8" is connected to the contact "PD-8" by the trace "TC-8." Thus, the wire "W-8" of the cable 10 is connected to the contact "PD-8."

Turning to FIG. 11B, the wires "W-4" and "W-5" (see FIG. 3D) of the twisted-wire pair "P1" of the cable 10 are connected to the VIAs "V-4" and "V-5," respectively, of the circuit 151 (e.g., by the insulation displacement connectors "IDC4" and "IDC5," respectively). On the second side 82, the VIA "V-4" is connected to the contact "PD-4" by the trace "TC-4." Thus, the wire "W-4" of the cable 10 is connected to the contact "PD-4." On the second side 82, the VIA "V-5" is connected to the contact "PD-5" by the trace "TC-5." Thus, the wire "W-5" of the cable 10 is connected to the contact "PD-5."

The wires "W-3" and "W-6" (see FIG. 3D) of the twisted-wire pair "P3" of the cable 10 are connected to the VIAs "V-3" and "V-6," respectively, of the circuit 151 (e.g., by the insulation displacement connectors "IDC3" and "IDC6," respectively). On the second side 82, the VIA "V-3" is connected to the contact "PD-3" by the trace "TC-3." Thus, the wire "W-3" of the cable 10 is connected to the contact "PD-3." On the second side 82, the VIA "V-6" is connected to the contact "PD-6" by the trace "TC-6." Thus, the wire "W-6" of the cable 10 is connected to the contact "PD-6."

Turning to FIG. 11A, to improve isolation, on the first side 80, the first layer "GPL1" of the ground plane "GP-1" has a portion positioned between the traces "TC-1" and "TC-2," and the traces "TC-7" and "TC-8." Similarly, referring to FIG. 11B, on the second side 82, the fourth layer "GPL4" of the ground plane "GP-1" has a portion positioned between the traces "TC-3" and "TC-6," and the traces "TC-4" and "TC-5."

Turning to FIG. 11A, the slot "M1" (formed in the first end portion 122 of the horizontal substrate 70) is positioned between the contacts "PD-1" and "PD-2" and the contacts "PD-7" and "PD-8" on the first side 80 of the horizontal substrate 70. Further, turning to FIG. 11B, the slot "M1" is positioned between the contacts "PD-4" and "PD-5" and the contacts "PD-3" and "PD-6" on the second side 82 of the horizontal substrate 70.

Vertical Substrate 72

Figure 12:
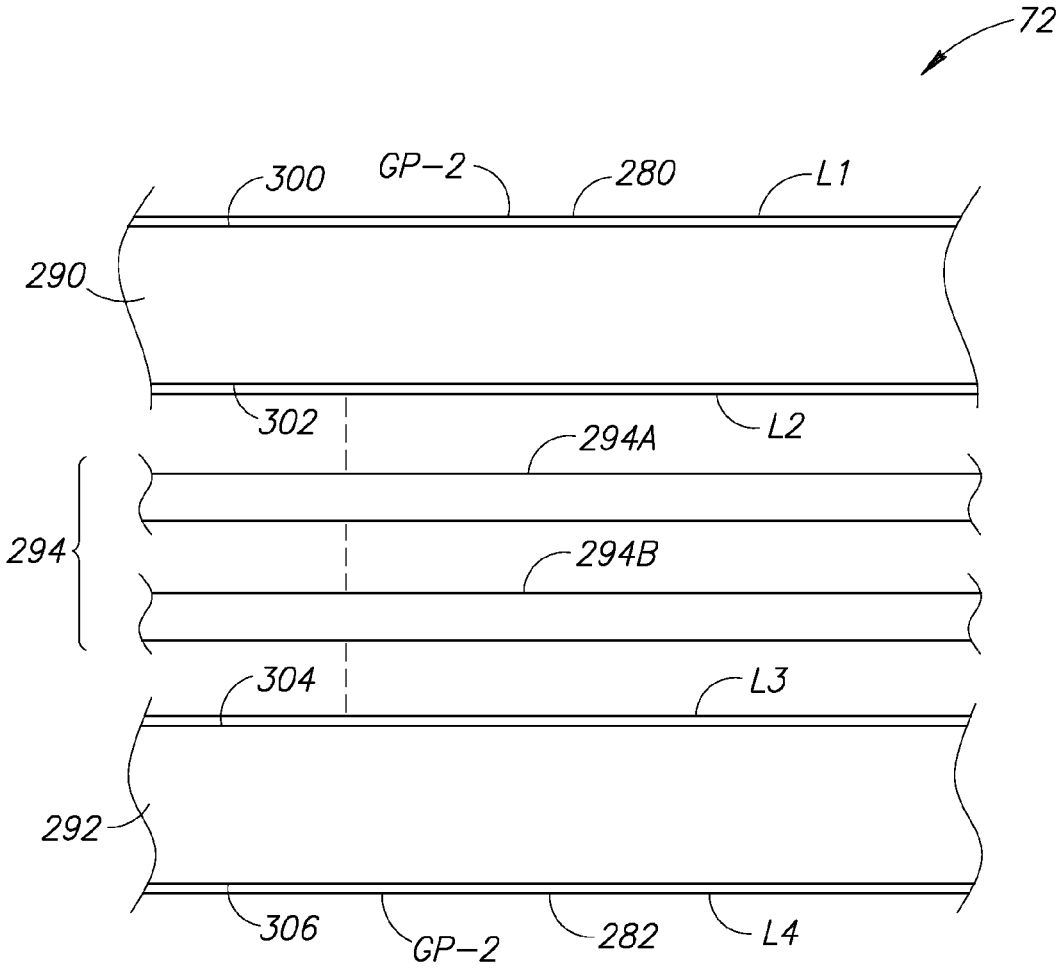
FIG. 12 is a cross-sectional view of a vertical substrate of the outlet of FIG. 3A rotated 90 degrees.

Turning to FIG. 5, the vertical substrate 72 has a first side 280 opposite a second side 282 (see FIG. 3E). FIG. 12 is a cross-sectional view of the vertical substrate 72. Turning to FIG. 12, the vertical substrate 72 includes a first substrate layer 290 and a second substrate layer 292 with an insulating layer 294 positioned between the first and second substrate layers. By way of a non-limiting example, the first and second substrate layers 290 and 292 may be constructed from a conventional core material used to construct conventional printed circuit boards and the insulating layer 294 may be constructed from a pre-impregnated material used to construct conventional printed circuit boards commonly referred to as "prepreg." By way of a non-limiting example, the insulating layer 294 may include a first insulating layer 294A adjacent the first layer 290 and a second insulating layer 294B adjacent the second layer 292.

The first layer 290 has a first surface 300 opposite a second surface 302 and the second layer 292 has a first surface 304 opposite a second surface 306. The second surface 302 of the first layer 290 is adjacent the insulating layer 294 and the first surface 304 of the second layer 292 is adjacent the insulating layer 294.

As mentioned above, elements including or constructed from conductive material (e.g., traces, printed wires, lands, pads, planes, and the like) are categorized herein in two groups. The first group includes signal carrying conductive path elements, and the second group includes specialized ground planes. In the embodiment illustrated, the vertical substrate 72 includes only elements belonging to the second group.

The vertical substrate 72 includes a ground plane "GP-2" that is electrically connected to the ground plane "GP-1" of the horizontal substrate 70. The ground plane "GP-2" illustrated is implemented as a localized, electrically floating, isolated ground plane ("LEFIGP"). However, the ground plane "GP-2" may be electrically connected to similar corresponding structures on adjacent mated substrates (e.g., the horizontal substrate 70) and/or additional local shield elements such as those used to shroud the outlets 20 (illustrated in FIG. 2). Together the ground planes "GP-1" and "GP-2" may function as a single LEFIGP.

Figure 13:
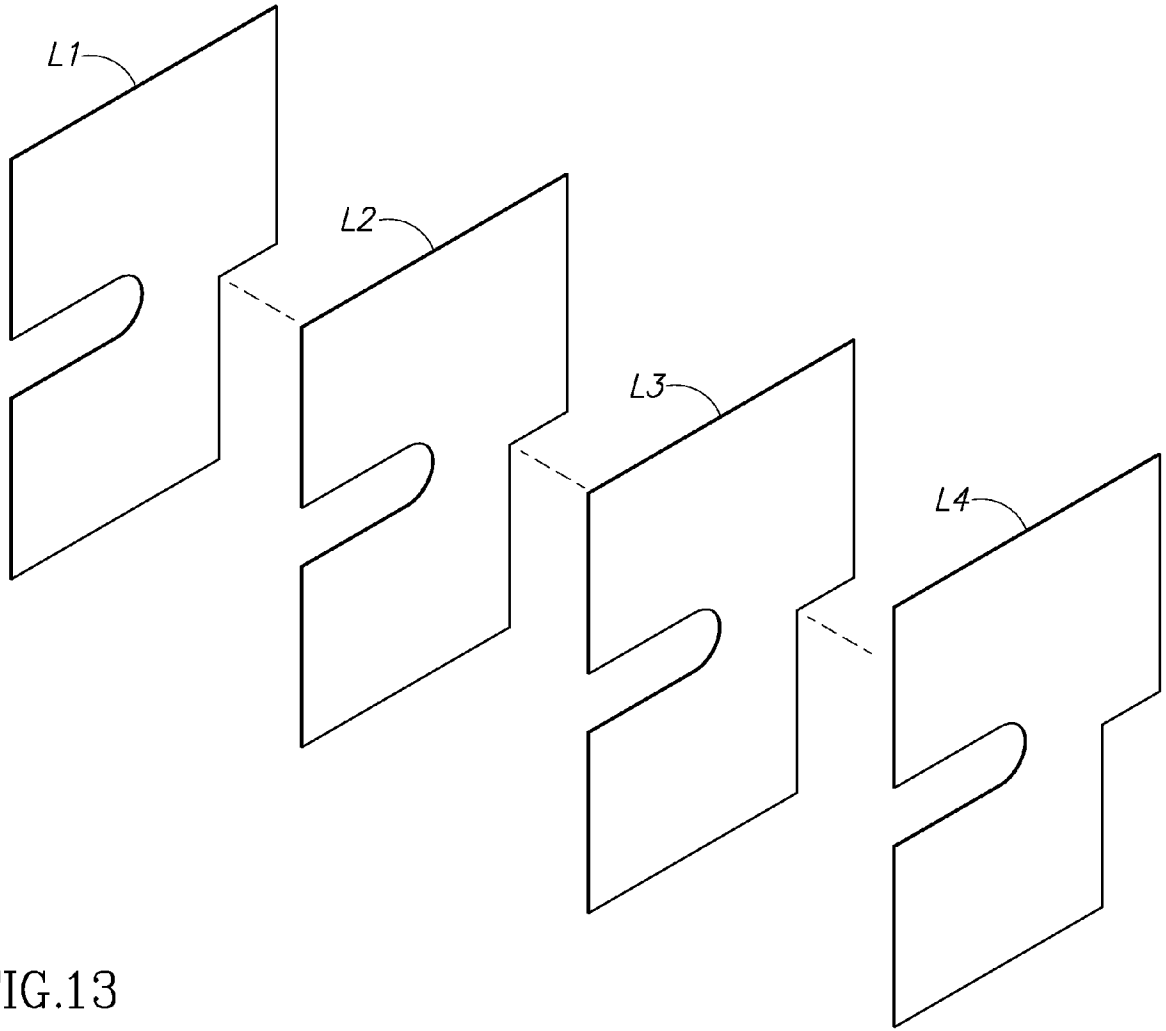
FIG. 13 is an exploded perspective view of a second ground plane of the vertical substrate of FIG. 12.

Referring to FIGS. 12 and 13, the ground plane "GP-2" has four different layers "L1," "L2," "L3," and "L4." Referring to FIG. 12, the first ground plane layer "L1" is positioned on the first surface 300 of the first layer 290. The second ground plane layer "L2" is positioned on the second surface 302 of the first layer 290. The third ground plane layer "L3" is positioned on the first surface 304 of the second layer 292. The fourth ground plane layer "L4" is positioned on the second surface 306 of the second layer 292.

The ground plane "GP-2" includes conductive material positioned on the four layers "L1" to "L4." The layers "L1" to "L4" are substantially aligned with one another. The four layers "L1" to "L4" may be interconnected by the VIAs (not shown). In the embodiment illustrated, the slot "M2" is formed in the vertical substrate 72 and the ground plane "GP-2." At least a portion of the slot "M2" is coated (or plated) with an electrically conductive material that interconnects the layers "L1" to "L4."

Figure 14:
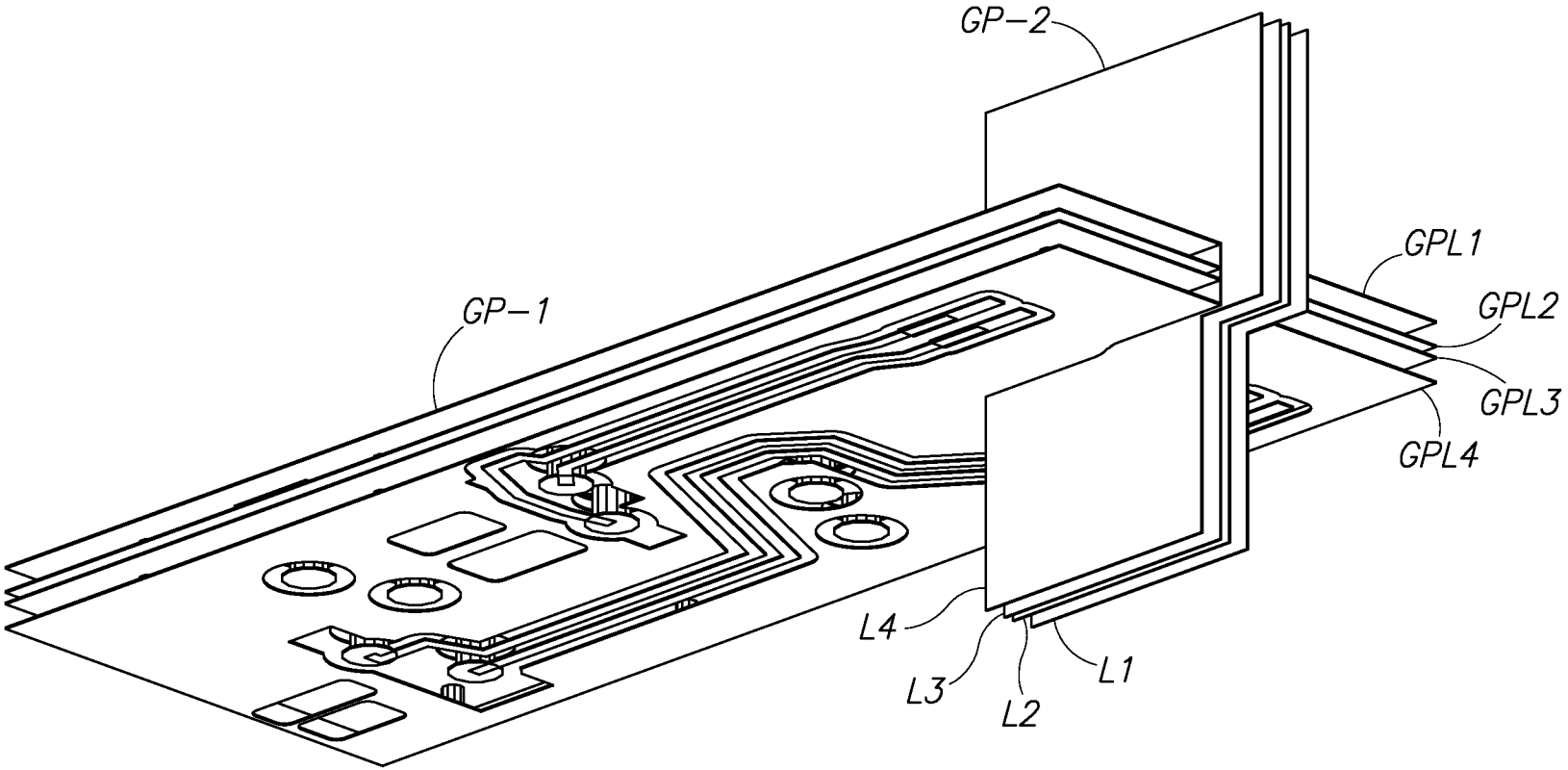
FIG. 14 is a perspective view of the first and second ground planes and the circuit of FIG. 8.

As may be viewed in FIGS. 5 and 14, the slot "M2" is configured to mate with the slot "M1" formed in the horizontal substrate 70 (and the ground plane "GP-1") and form an electrical connection with the conductive material positioned in the slot "M1" (that connects the layers "GPL1" to "GPL4" together). In the embodiment illustrated, the vertical substrate 72 is substantially orthogonal to the horizontal substrate 70 when the slots "M1" and "M2" are mated together. Thus, when the slots "M1" and "M2" are mated together, the horizontal and vertical substrates 70 and 72 form a generally t-shaped structure that corresponds to the t-shaped portion of the plug shield 46 (see FIGS. 3C and 7). Thus, together the plug shield 46 and the horizontal and vertical substrates 70 and 72 divide (and shield) the signal carrying elements connected to the twisted-wire pairs "P1" to "P4" across the plug-outlet interface.

The foregoing described embodiments depict different components contained within, or connected with, different other components. It is to be understood that such depicted architectures are merely exemplary, and that in fact many other architectures can be implemented which achieve the same functionality. In a conceptual sense, any arrangement of components to achieve the same functionality is effectively "associated" such that the desired functionality is achieved. Hence, any two components herein combined to achieve a particular functionality can be seen as "associated with" each other such that the desired functionality is achieved, irrespective of architectures or intermedial components. Likewise, any two components so associated can also be viewed as being "operably connected," or "operably coupled," to each other to achieve the desired functionality.

While particular embodiments of the present invention have been shown and described, it will be obvious to those skilled in the art that, based upon the teachings herein, changes and modifications may be made without departing from this invention and its broader aspects and, therefore, the appended claims are to encompass within their scope all such changes and modifications as are within the true spirit and scope of this invention. Furthermore, it is to be understood that the invention is solely defined by the appended claims. It will be understood by those within the art that, in general, terms used herein, and especially in the appended claims (e.g., bodies of the appended claims) are generally intended as "open" terms (e.g., the term "including" should be interpreted as "including but not limited to," the term "having" should be interpreted as "having at least," the term "includes" should be interpreted as "includes but is not limited to," etc.). It will be further understood by those within the art that if a specific number of an introduced claim recitation is intended, such an intent will be explicitly recited in the claim, and in the absence of such recitation no such intent is present. For example, as an aid to understanding, the following appended claims may contain usage of the introductory phrases "at least one" and "one or more" to introduce claim recitations. However, the use of such phrases should not be construed to imply that the introduction of a claim recitation by the indefinite articles "a" or "an" limits any particular claim containing such introduced claim recitation to inventions containing only one such recitation, even when the same claim includes the introductory phrases "one or more" or "at least one" and indefinite articles such as "a" or "an" (e.g., "a" and/or "an" should typically be interpreted to mean "at least one" or "one or more"); the same holds true for the use of definite articles used to introduce claim recitations. In addition, even if a specific number of an introduced claim recitation is explicitly recited, those skilled in the art will recognize that such recitation should typically be interpreted to mean at least the recited number (e.g., the bare recitation of "two recitations," without other modifiers, typically means at least two recitations, or two or more recitations).

Accordingly, the invention is not limited except as by the appended claims.

The invention claimed is:

1. An outlet comprising:

a first substrate comprising a first ground plane and an electrical circuit, the electrical circuit being adjacent to the first ground plane and spaced apart therefrom, wherein the first ground plane comprises a first plurality of layers with a different substantially non-conductive layer being positioned between each adjacent pair of the first plurality of layers, the first plurality of layers being electrically connected to one another;

a second substrate comprising a second ground plane electrically connected to the first ground plane, the electrical circuit being spaced apart from the second ground plane, wherein the second ground plane comprises a second plurality of layers with a different substantially non-conductive layer being positioned between each adjacent pair of the second plurality of layers, the second plurality of layers being electrically connected to one another; and a plurality of electrical contacts positioned adjacent to the first and second substrates, each of the plurality of electrical contacts being connected to the electrical circuit.

2. The outlet of claim 1, wherein the first substrate is substantially orthogonal to the second substrate such that the first and second substrates define four regions; and the plurality of electrical contacts comprises a different pair of electrical contacts corresponding to each of the four regions, each of the different pairs having a portion positioned inside the corresponding region.

3. The outlet of claim 1, wherein the first and second ground planes together form a localized, electrically floating, isolated ground plane.

4. The outlet of claim 1 for use with a plug comprising an electrically conductive plug shield, the first and second ground planes being electrically connected to the plug shield.

5. The outlet of claim 4, further comprising at least one ground contact electrically connecting the first ground plane to the plug shield.

6. The outlet of claim 1 wherein the first substrate comprises a first slot, and the second substrate comprises a second slot configured to mate with the first slot.

7. The outlet of claim 1, wherein the first substrate comprises a first slot having a first conductor disposed therein that electrically connects the first plurality of layers to one another, the second substrate comprises a second slot having a second conductor disposed therein that electrically connects the second plurality of layers to one another, and the second slot is configured to mate with the first slot with the second conductor contacting the first conductor to form an electrical connection between the first and second conductors.

8. The outlet of claim 1, further comprising a plurality of electrical connectors, each electrical connector being configured to form an electrical connection with a wire, the electrical circuit comprising a plurality of electrical pathways, each pathway corresponding to a different one of the plurality of electrical connectors and connecting the different one of the plurality of electrical connectors to a different one of the plurality of electrical contacts.

9. The outlet of claim 8, wherein each of the plurality of electrical connectors is mounted on the first substrate.

10. The outlet of claim 9, wherein each of the plurality of electrical connectors is an insulation displacement connector.

11. The outlet of claim 9, wherein the first substrate has a first surface opposite a second surface, a first portion of the plurality of electrical connectors extends outwardly from the first surface of the first substrate, and a second portion of the plurality of electrical connectors extends outwardly from the second surface of the first substrate.

12. The outlet of claim 1, wherein the first substrate has a first surface opposite a second surface, the electrical circuit has a first portion disposed on the first surface of the first substrate, the electrical circuit has a second portion disposed on the second surface of the first substrate, a first portion of the plurality of electrical contacts are connected to the first portion of the electrical circuit, and a different second portion of the plurality of electrical contacts are connected to the second portion of the electrical circuit such that the first portion of the plurality of electrical contacts are physically separated from the second portion of the plurality of electrical contacts by the first substrate.

13. The outlet of claim 12, wherein at least a portion of the second substrate divides a portion of a first side of the first substrate from a portion of a second side of the first substrate, the first portion of the plurality of electrical contacts comprising a first pair of contacts connected to the electrical circuit on the first side of the first substrate, the first portion of the plurality of electrical contacts comprising a second pair of contacts connected to the electrical circuit on the second side of the first substrate, the first pair being at least partially separated from the second pair by the second substrate, the second portion of the plurality of electrical contacts comprising a third pair of contacts connected to the electrical circuit on the first side of the first substrate, the second portion of the plurality of electrical contacts comprising a fourth pair of contacts connected to the electrical circuit on the second side of the first substrate, the third pair being at least partially separated from the fourth pair by the second substrate.

14. The outlet of claim 1 for use with a plug comprising an electrically conductive plug shield comprising a t-shaped or crucifix-shaped divider portion defining four plug regions, the first and second ground planes being positioned relative to one another to form a t-shaped or crucifix-shaped assembly defining four outlet regions juxtaposed with the divider portion of the plug shield such that the four plug regions are substantially aligned and continuous with the four outlet regions.

15. The outlet of claim 1 for use with a plug, the outlet further comprising:

a housing in which at least a portion of the first substrate and a portion of the second substrate are housed, the housing comprising a height and an opening configured to receive the plug, the height of the housing being such that two like housings have a combined height of less than 1.75 inches.

16. The outlet of claim 1 for use with a plug and a one rack unit patch panel, the outlet further comprising:

a housing in which at least a portion of the first substrate and a portion of the second substrate are housed, the housing comprising an opening configured to receive the plug, the housing being configured such that 48 like housings are mountable within the one rack unit patch panel.

17. A cable assembly for use with a plug comprising a plurality of pairs of plug contacts, the cable assembly comprising:

a cable having an end and a plurality of pairs of wires, each pair of wires being configured to conduct a differential signal; and an outlet connected to the end of the cable, the outlet comprising a plurality of pairs of connectors, a plurality of pairs of outlet contacts, and a floating ground plane, each of the pairs of connectors being electrically connected to a different one of the pairs of outlet contacts, a different one of the pairs of connectors being electrically connected to each pair of wires of the cable, the outlet being configured to receive the plug and form an electrical connection between each the pairs of plug contacts and a different one of the pairs of outlet contacts, the floating ground plane having portions positioned at least partially between the pairs of outlet contacts.

18. The cable assembly of claim 17, wherein the floating ground plane is a localized, electrically floating, isolated ground plane.

19. The cable assembly of claim 17, wherein the floating ground plane is shaped to define regions with each of the pairs of outlet contacts being at least partially positioned inside a different one of the regions.

20. The cable assembly of claim 17, wherein the cable comprises at least one of a drain wire and a cable shield, the at least one drain wire and the cable shield being electrically connected to the floating ground plane.

21. The cable assembly of claim 17 for use with the plug comprising a plug shield, wherein the outlet further comprises at least one ground contact configured to electrically connect the floating ground plane to the plug shield.

22. The cable assembly of claim 17, wherein the outlet is configured in accordance with the Registered Jack 45 ("RJ45") standard.

23. The cable assembly of claim 17, wherein the cable is a Class $F_A$ or Type $F_A$ cable.

24. The cable assembly of claim 17, wherein each pair of wires is configured to conduct the differential sign at a transmission frequency of up to 1000 MHz.

25. An outlet comprising:

a first substrate comprising a first ground plane and an electrical circuit, the electrical circuit being adjacent to the first ground plane and spaced apart therefrom;

a second substrate comprising a second ground plane electrically connected to the first ground plane, the electrical circuit being spaced apart from the second ground plane;

a plurality of electrical contacts positioned adjacent to the first and second substrates, each of the plurality of electrical contacts being connected to the electrical circuit; and a plurality of electrical connectors, each electrical connector being configured to form an electrical connection with a wire, the electrical circuit comprising a plurality of electrical pathways, each pathway corresponding to a different one of the plurality of electrical connectors and connecting the different one of the plurality of electrical connectors to a different one of the plurality of electrical contacts.

26. The outlet of claim 25, wherein the first substrate is substantially orthogonal to the second substrate such that the first and second substrates define four regions; and the plurality of electrical contacts comprises a different pair of electrical contacts corresponding to each of the four regions, each of the different pairs having a portion positioned inside the corresponding region.

27. The outlet of claim 25, wherein the first and second ground planes together form a localized, electrically floating, isolated ground plane.

28. The outlet of claim 25 for use with a plug comprising an electrically conductive plug shield, the first and second ground planes being electrically connected to the plug shield.

29. The outlet of claim 28, further comprising at least one ground contact electrically connecting the first ground plane to the plug shield.

30. The outlet of claim 25 wherein the first substrate comprises a first slot, and the second substrate comprises a second slot configured to mate with the first slot.

31. The outlet of claim 25 wherein the first ground plane comprises a first plurality of layers with a different substantially non-conductive layer being positioned between each adjacent pair of the first plurality of layers, the first plurality of layers being electrically connected to one another, the second ground plane comprises a second plurality of layers with a different substantially non-conductive layer being positioned between each adjacent pair of the second plurality of layers, the second plurality of layers being electrically connected to one another, the first substrate comprises a first slot having a first conductor disposed therein that electrically connects the first plurality of layers to one another, the second substrate comprises a second slot having a second conductor disposed therein that electrically connects the second plurality of layers to one another, and the second slot is configured to mate with the first slot with the second conductor contacting the first conductor to form an electrical connection between the first and second conductors.

32. The outlet of claim 25, wherein each of the plurality of electrical connectors is mounted on the first substrate.

33. The outlet of claim 25, wherein each of the plurality of electrical connectors is an insulation displacement connector.

34. The outlet of claim 25, wherein the first substrate has a first surface opposite a second surface, a first portion of the plurality of electrical connectors extends outwardly from the first surface of the first substrate, and a second portion of the plurality of electrical connectors extends outwardly from the second surface of the first substrate.

35. The outlet of claim 25, wherein the first substrate has a first surface opposite a second surface, the electrical circuit has a first portion disposed on the first surface of the first substrate, the electrical circuit has a second portion disposed on the second surface of the first substrate, a first portion of the plurality of electrical contacts are connected to the first portion of the electrical circuit, and a different second portion of the plurality of electrical contacts are connected to the second portion of the electrical circuit such that the first portion of the plurality of electrical contacts are physically separated from the second portion of the plurality of electrical contacts by the first substrate.

36. The outlet of claim 35, wherein at least a portion of the second substrate divides a portion of a first side of the first substrate from a portion of a second side of the first substrate, the first portion of the plurality of electrical contacts comprising a first pair of contacts connected to the electrical circuit on the first side of the first substrate, the first portion of the plurality of electrical contacts comprising a second pair of contacts connected to the electrical circuit on the second side of the first substrate, the first pair being at least partially separated from the second pair by the second substrate, the second portion of the plurality of electrical contacts comprising a third pair of contacts connected to the electrical circuit on the first side of the first substrate, the second portion of the plurality of electrical contacts comprising a fourth pair of contacts connected to the electrical circuit on the second side of the first substrate, the third pair being at least partially separated from the fourth pair by the second substrate.

37. The outlet of claim 25 for use with a plug comprising an electrically conductive plug shield comprising a t-shaped or crucifix-shaped divider portion defining four plug regions, the first and second ground planes being positioned relative to one another to form a t-shaped or crucifix-shaped assembly defining four outlet regions juxtaposed with the divider portion of the plug shield such that the four plug regions are substantially aligned and continuous with the four outlet regions.

38. The outlet of claim 25 for use with a plug, the outlet further comprising:

a housing in which at least a portion of the first substrate and a portion of the second substrate are housed, the housing comprising a height and an opening configured to receive the plug, the height of the housing being such that two like housings have a combined height of less than 1.75 inches.

39. The outlet of claim 25 for use with a plug and a one rack unit patch panel, the outlet further comprising:

a housing in which at least a portion of the first substrate and a portion of the second substrate are housed, the housing comprising an opening configured to receive the plug, the housing being configured such that 48 like housings are mountable within the one rack unit patch panel.

40. An outlet comprising:

a first substrate comprising a first ground plane, an electrical circuit, and a first surface opposite a second surface, the electrical circuit being adjacent to the first ground plane and spaced apart therefrom, the electrical circuit having first and second portions disposed on the first and second surfaces, respectively, of the first substrate, a second substrate comprising a second ground plane electrically connected to the first ground plane, the electrical circuit being spaced apart from the second ground plane; and a plurality of electrical contacts positioned adjacent to the first and second substrates, each of the plurality of electrical contacts being connected to the electrical circuit, a first portion of the plurality of electrical contacts being connected to the first portion of the electrical circuit, and a different second portion of the plurality of electrical contacts being connected to the second portion of the electrical circuit such that the first portion of the plurality of electrical contacts are physically separated from the second portion of the plurality of electrical contacts by the first substrate.

41. The outlet of claim 40, wherein at least a portion of the second substrate divides a portion of a first side of the first substrate from a portion of a second side of the first substrate, the first portion of the plurality of electrical contacts comprising a first pair of contacts connected to the electrical circuit on the first side of the first substrate, the first portion of the plurality of electrical contacts comprising a second pair of contacts connected to the electrical circuit on the second side of the first substrate, the first pair being at least partially separated from the second pair by the second substrate, the second portion of the plurality of electrical contacts comprising a third pair of contacts connected to the electrical circuit on the first side of the first substrate, the second portion of the plurality of electrical contacts comprising a fourth pair of contacts connected to the electrical circuit on the second side of the first substrate, the third pair being at least partially separated from the fourth pair by the second substrate.

42. The outlet of claim 40 wherein the first ground plane comprises a first plurality of layers with a different substantially non-conductive layer being positioned between each adjacent pair of the first plurality of layers, the first plurality of layers being electrically connected to one another, the second ground plane comprises a second plurality of layers with a different substantially non-conductive layer being positioned between each adjacent pair of the second plurality of layers, the second plurality of layers being electrically connected to one another, the first substrate comprises a first slot having a first conductor disposed therein that electrically connects the first plurality of layers to one another, the second substrate comprises a second slot having a second conductor disposed therein that electrically connects the second plurality of layers to one another, and the second slot is configured to mate with the first slot with the second conductor contacting the first conductor to form an electrical connection between the first and second conductors.

43. The outlet of claim 40, wherein the first substrate is substantially orthogonal to the second substrate such that the first and second substrates define four regions; and the plurality of electrical contacts comprises a different pair of electrical contacts corresponding to each of the four regions, each of the different pairs having a portion positioned inside the corresponding region.

44. The outlet of claim 40, wherein the first and second ground planes together form a localized, electrically floating, isolated ground plane.

45. The outlet of claim 40 for use with a plug comprising an electrically conductive plug shield, the first and second ground planes being electrically connected to the plug shield.

46. The outlet of claim 45, further comprising at least one ground contact electrically connecting the first ground plane to the plug shield.

47. The outlet of claim 40 wherein the first substrate comprises a first slot, and the second substrate comprises a second slot configured to mate with the first slot.

48. The outlet of claim 40, further comprising a plurality of electrical connectors each mounted on the first substrate, each electrical connector being configured to form an electrical connection with a wire, the electrical circuit comprising a plurality of electrical pathways, each pathway corresponding to a different one of the plurality of electrical connectors and connecting the different one of the plurality of electrical connectors to a different one of the plurality of electrical contacts.

49. The outlet of claim 48, wherein each of the plurality of electrical connectors is an insulation displacement connector.

50. The outlet of claim 48, wherein the first substrate has a first surface opposite a second surface, a first portion of the plurality of electrical connectors extends outwardly from the first surface of the first substrate, and a second portion of the plurality of electrical connectors extends outwardly from the second surface of the first substrate.

51. The outlet of claim 40 for use with a plug comprising an electrically conductive plug shield comprising a t-shaped or crucifix-shaped divider portion defining four plug regions, the first and second ground planes being positioned relative to one another to form a t-shaped or crucifix-shaped assembly defining four outlet regions juxtaposed with the divider portion of the plug shield such that the four plug regions are substantially aligned and continuous with the four outlet regions.

52. The outlet of claim 40 for use with a plug, the outlet further comprising:

a housing in which at least a portion of the first substrate and a portion of the second substrate are housed, the housing comprising a height and an opening configured to receive the plug, the height of the housing being such that two like housings have a combined height of less than 1.75 inches.

53. The outlet of claim 40 for use with a plug and a one rack unit patch panel, the outlet further comprising:

a housing in which at least a portion of the first substrate and a portion of the second substrate are housed, the housing comprising an opening configured to receive the plug, the housing being configured such that 48 like housings are mountable within the one rack unit patch panel.

* * * * *